US009022903B2

(12) United States Patent
Rafih et al.

(10) Patent No.: US 9,022,903 B2
(45) Date of Patent: May 5, 2015

(54) ORAL APPLIANCE FOR IMPROVING STRENGTH AND BALANCE

(76) Inventors: Zaki Rafih, Central Onslow (CA); Anil Makkar, Bible Hill (CA)

( * ) Notice: Subject to any disclaimer, the term of this patent is extended or adjusted under 35 U.S.C. 154(b) by 827 days.

(21) Appl. No.: 13/046,039

(22) Filed: Mar. 11, 2011

(65) Prior Publication Data

US 2012/0231932 A1 Sep. 13, 2012

(51) Int. Cl.
*A63B 21/00* (2006.01)
*A63B 71/08* (2006.01)

(52) U.S. Cl.
CPC ..... *A63B 71/085* (2013.01)

(58) Field of Classification Search
USPC ..... 433/71, 48, 214; 482/11, 48, 71
See application file for complete search history.

(56) References Cited

U.S. PATENT DOCUMENTS 3,984,875 A 10/1976 Farquharson
D243,127 S 1/1977 Farquharson
4,791,941 A 12/1988 Schaefer
5,206,955 A 5/1993 Milligan
5,267,353 A 12/1993 Milligan
5,513,984 A 5/1996 Ueno
5,746,221 A 5/1998 Jones
5,947,918 A 9/1999 Jones
6,028,627 A 2/2000 Helmsderfer
6,196,840 B1 * 3/2001 Zentz et al. ..... 433/71
6,200,133 B1 3/2001 Kittelsen
6,237,601 B1 5/2001 Kittelsen et al.
6,415,794 B1 7/2002 Kittelsen et al.
6,505,627 B2 1/2003 Kittelsen et al.
6,505,628 B2 1/2003 Kittelsen et al.
6,539,943 B1 4/2003 Kittelsen et al.
6,553,996 B2 4/2003 Kittelsen et al.
6,588,430 B2 7/2003 Kittelsen et al.

(Continued)

FOREIGN PATENT DOCUMENTS

CA 1296488 A1 3/1992
CA 2137357 11/1999

(Continued)

OTHER PUBLICATIONS

Dr. Michael Bixby, Mouthguards, retrieved on Mar. 9, 2011 from http://www.purepowermouthguard-ppm.com/.

(Continued)

*Primary Examiner* — Jerome W Donnelly

(57) ABSTRACT

A neuromuscular oral appliance comprises a channel with a base adapted to accept teeth from one of an upper and a lower jaw. The oral appliance further comprises a bite pad adapted to accept teeth from the other of the upper jaw and the lower jaw, the bite pad extending from the base and including a pliable chamber that partially deforms when compressed. The oral appliance allows the lower jaw to find a balanced position relative to the upper jaw which will correspond to a position at which the facial muscles are generally at minimal tension. It has been observed that the lower jaw is naturally urged forward relative to the upper jaw in this position. This motion and the position of the lower jaw generally tend to urge the neck backward so that the cervical vertebrae substantially align, thereby facilitating an erect spine. The compliant property of the bite pads further allow slippage and repositioning of the upper and lower jaws relative to one another to adjust for changes in facial muscle tension, for example, when the head is turned to face the side of a user's body, or when a user is off-balance.

24 Claims, 32 Drawing Sheets

(56) References Cited

U.S. PATENT DOCUMENTS

| | | | |
|---|---|---|---|
| 6,598,605 | B1 | 7/2003 | Kittelsen et al. |
| 6,626,180 | B1 | 9/2003 | Kittelsen et al. |
| 6,675,807 | B2 | 1/2004 | Kittelsen |
| D496,154 | S | 9/2004 | Herman et al. |
| 6,951,678 | B2 | 10/2005 | Takeshita |
| 7,299,804 | B2 | 11/2007 | Kttelsen |
| 7,328,705 | B2 | 2/2008 | Abramson |
| 7,353,828 | B1 | 4/2008 | Hirshberg |
| 7,581,542 | B2 | 9/2009 | Abramson |
| 7,708,018 | B1 | 5/2010 | Hirshberg |
| 2002/0144690 | A1 | 10/2002 | Kittelsen |
| 2002/0144693 | A1 | 10/2002 | Kittelsen |
| 2003/0101999 | A1 | 6/2003 | Kittelsen |
| 2003/0145863 | A1 | 8/2003 | Fischer |
| 2004/0177852 | A1 | 9/2004 | Abramson |
| 2009/0038624 | A1 | 2/2009 | Akervall |
| 2009/0308403 | A1 | 12/2009 | Roettger et al. |
| 2010/0129763 | A1 | 5/2010 | Kuo |

FOREIGN PATENT DOCUMENTS

| | | | |
|---|---|---|---|
| EP | 0605912 | A2 | 7/1994 |
| EP | 1398061 | A3 | 4/2004 |
| EP | 1754463 | A1 | 2/2007 |
| EP | 1867309 | A1 | 12/2007 |
| EP | 1279478 | B1 | 3/2008 |
| EP | 1897609 | A2 | 3/2008 |
| EP | 1905491 | A1 | 4/2008 |
| EP | 2000111 | A1 | 12/2008 |
| EP | 2036514 | A1 | 3/2009 |
| JP | 05023353 | A | 2/1993 |
| JP | 11042311 | A2 | 2/1999 |
| JP | 2010006989 | A2 | 1/2010 |
| JP | 2010131181 | A2 | 6/2010 |
| WO | WO9325100 | A1 | 12/1993 |
| WO | WO2004110570 | A1 | 12/2004 |
| WO | WO2004080342 | A3 | 1/2006 |
| WO | WO2008134905 | A1 | 11/2008 |
| WO | WO2010008512 | C2 | 8/2010 |
| WO | WO2010058255 | A3 | 12/2010 |
| WO | WO2011014965 | A1 | 2/2011 |
| WO | WO2011022834 | A1 | 3/2011 |

OTHER PUBLICATIONS

P. Bracco, et al., Effects of Different Jaw Relations on Postural Stability in Human Subjects, Received Aug. 22, 2003, Accepted Nov. 27, 2003, 4 pages.

Shock Doctor, Mouthguards, retrieved on Mar. 9, 2011 from: http://www.shockdoctor.com/products/mouthguards.aspx.

Shawn M. Arent, et al., Effects of a Neuromuscular Dentistry-Designed Mouthguard on Muscular Endurance and Anaerobic Power, Submitted Apr. 26, 2010; Accepted Jul. 16, 2010, 7 pages.

Opro Shield, Mouthguards, retrieved on Mar. 9, 2011 from: http://www.oproshield.com/whyoproshield.php?cc=2&ws=10.

International Search Report dated Aug. 8, 2012 for Application No. PCT/IB2012/000535, 5 pages.

* cited by examiner

ORAL APPLIANCE FOR IMPROVING STRENGTH AND BALANCE

FIELD OF THE INVENTION

Embodiments of the present invention relate to oral appliances for improving strength and balance, and methods thereof.

BACKGROUND

Strength and balance are two key attributes of athletes, laborers, first responders, and other individuals whose work requires physical exertion. It has been observed that the relative positioning of the lower and upper jaw can affect both strength and balance. It would be desirable to have an appliance to position the jaws relative to one another such that one or both of strength and balance is increased and/or maximized. However, dental anatomy and bite patterns of users vary widely. Fabricating an oral appliance fitted to the mouth for any reason, such as to alleviate breathing problems or align crooked teeth, requires customization on an individual level, which can be expensive and inconvenient.

SUMMARY

Embodiments of the present invention are directed to neuromuscular oral appliances and methods for use therewith, for placement in a mouth of a user to improve balance and strength. In accordance with an embodiment, the oral appliance comprises a channel with a base adapted to accept teeth from one of a lower jaw and an upper jaw of the mouth. The channel is deformable to at least partially conform to a shape of the accepted teeth upon heating of the channel. The oral appliance further comprises a pliable, elastic bite pad extending opposite the channel. The bite pad is adapted to contact teeth from the other of the lower jaw and the upper jaw when the oral appliance is placed in the mouth and partially collapse such that a gap between the lower jaw and the upper jaw is preferably maintainable within a predefined range.

In accordance with an embodiment, the pliable, elastic bite pad includes a skin encapsulating a core. The core can be, for example, a silicone gel and the skin can be, for example, a silicone encasement. Alternatively, the core can be a fluid.

In accordance with an embodiment, the oral appliance comprises a pair of bite pads, the pair of bite pads extending upon contact from a first bicuspid to a first molar of the other of the lower jaw and the upper jaw on opposite sides of the mouth.

In accordance with an embodiment, the oral appliance further comprises a frame. The channel can be formed over the frame, and the frame has a higher melting temperature than the channel. For example, the channel can be made from ethylene vinyl acetate (EVA) and the frame can be made from TRITAN™ copolyester. Optionally, the bite pad is bonded to the frame.

In accordance with an embodiment, the channel of the oral appliance includes a plurality of fins arranged along at least a portion of the length of the channel, each of the plurality of fins preferably having a groove to guide the teeth into the channel. The grooves of the plurality of fins can be "V"-shaped and the arrangement of fins along the channel can be mirrored along a midline of the oral appliance.

In accordance with an embodiment, the channel includes a lingual wall, a lateral wall, and an occlusal wall connected between the lingual wall and the lateral wall. The lateral wall can extend at least to a gumline of the mouth to protect the accepted teeth from trauma. Further, the channel can optionally include two portions, each portion spanning at least from the first bicuspid to the second molar on opposite sides of the mouth. The two portions can be connected by a wire, for example.

Additional and alternative embodiments, features and advantages of the invention will appear from the following description in which the preferred embodiments have been set forth in detail, in conjunction with the accompanying drawings and claims.

DETAILED DESCRIPTION

Figure 1A:
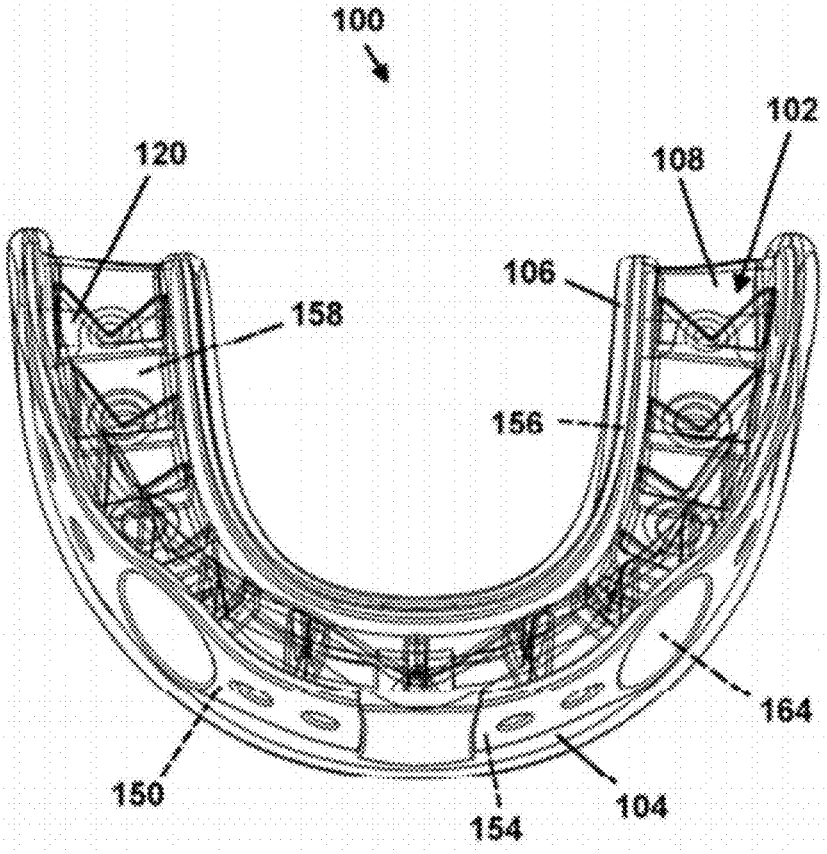
FIG. 1A is an anterior top perspective view of an embodiment of an oral appliance in accordance with the present invention that is adapted to be seated on the upper jaw.
Figure 1B:
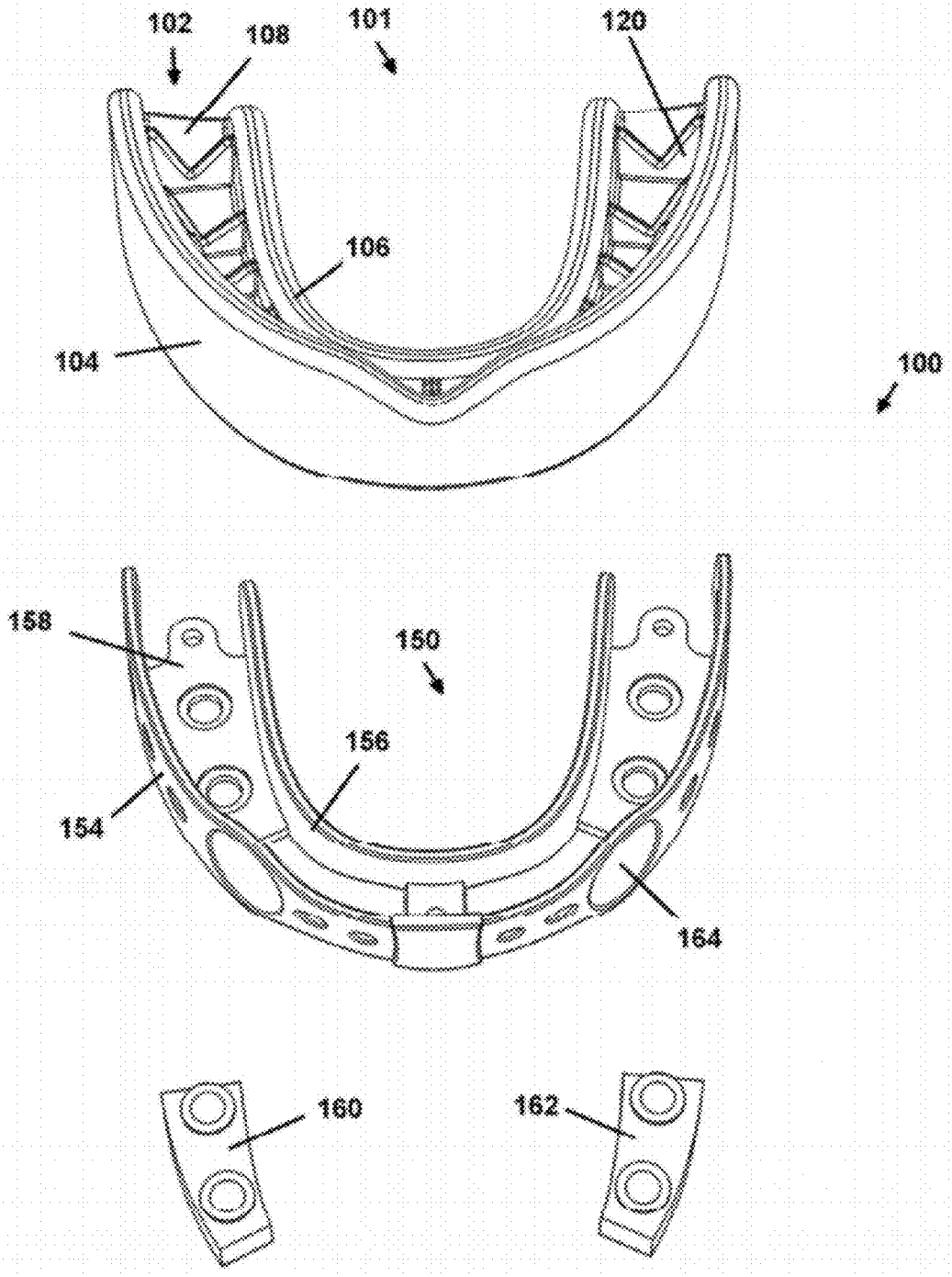
FIG. 1B is an exploded anterior top perspective view of the oral appliance of FIG. 1A.
Figure 2:
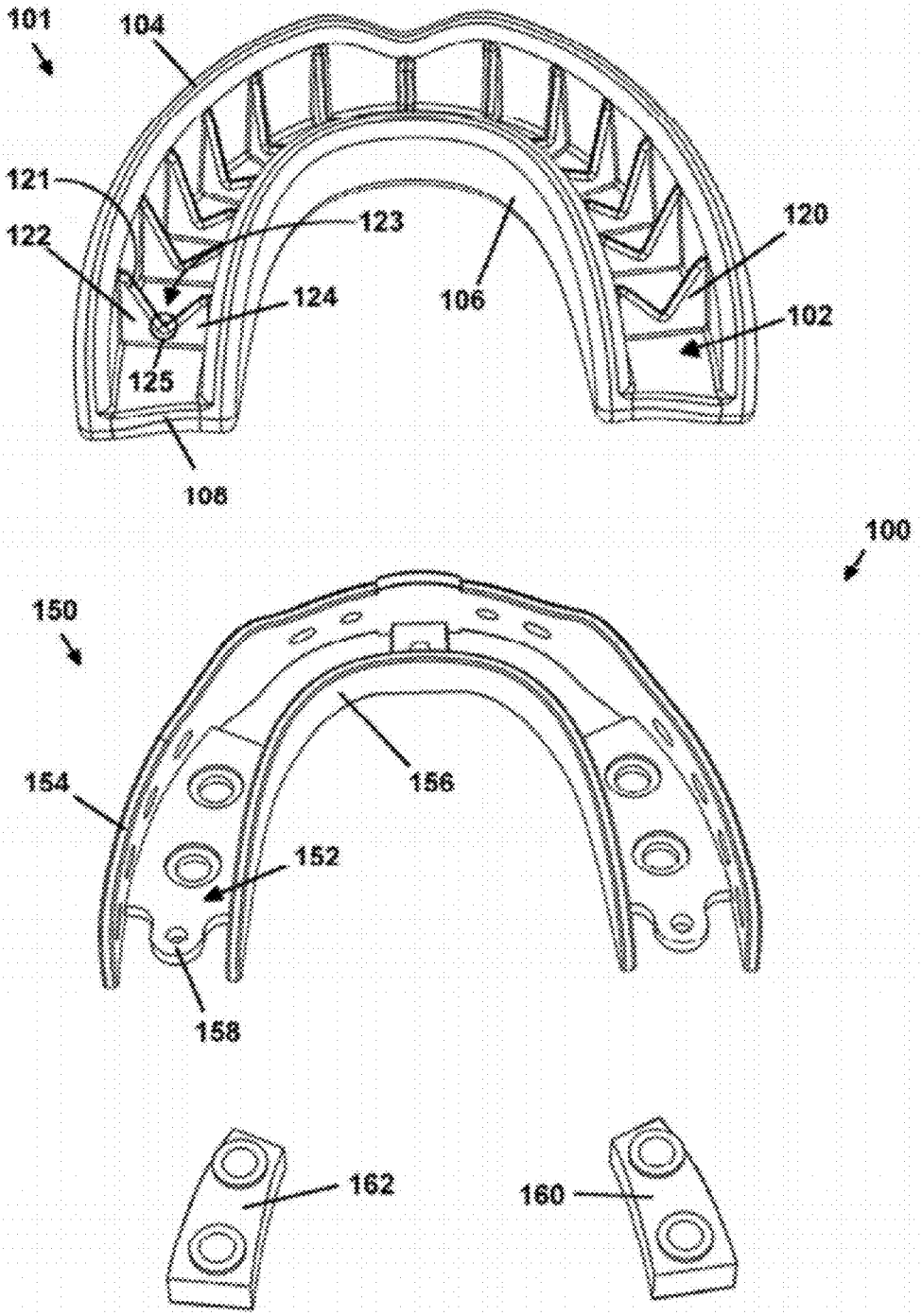
FIG. 2 is an exploded posterior top perspective view of the oral appliance of FIG. 1 showing the seating surface that can be molded to conform to the upper jaw of a user.
Figure 3:
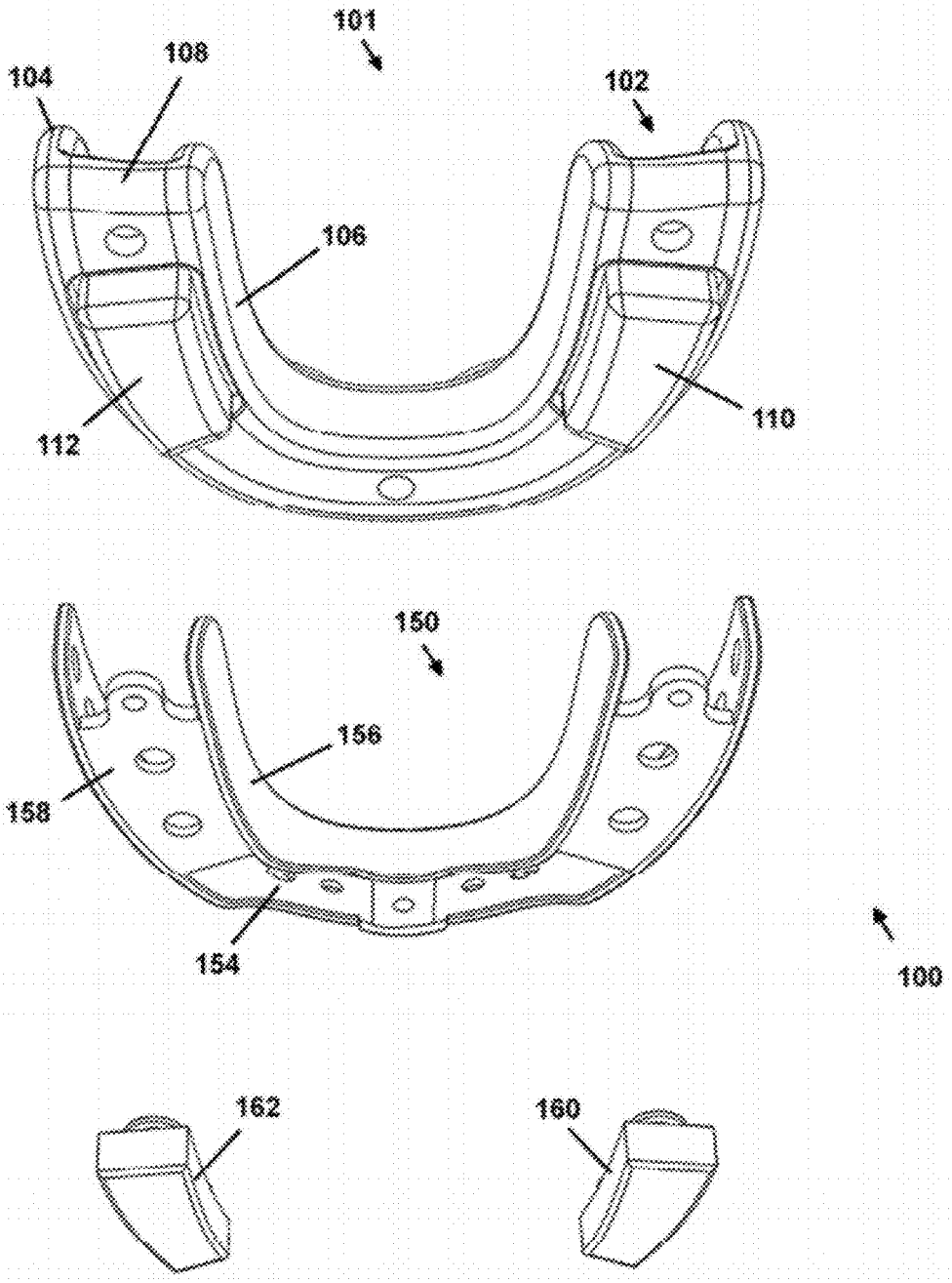
FIG. 3 is an exploded posterior bottom perspective view of the oral appliance of FIG. 1A.
Figure 4:
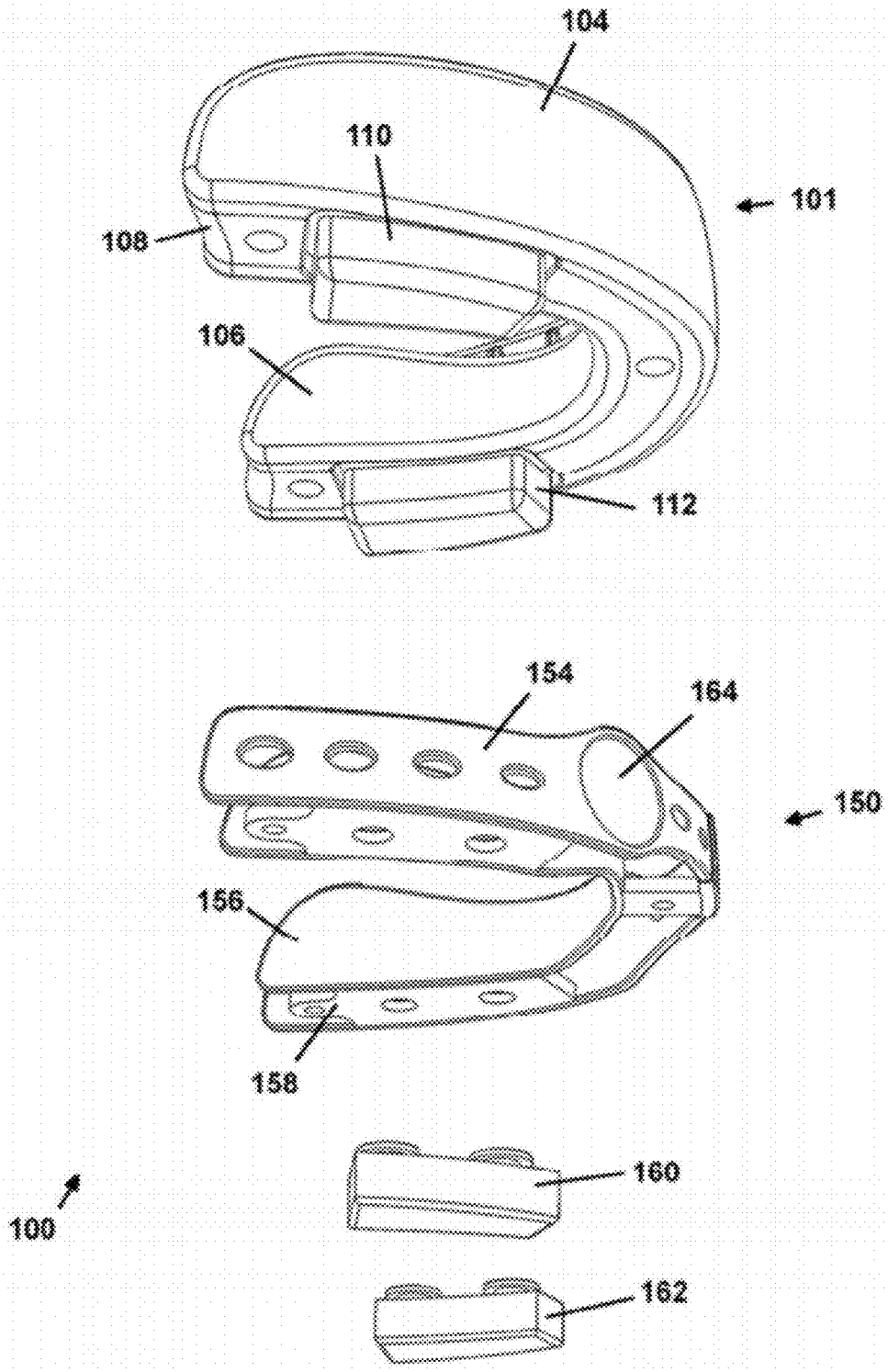
FIG. 4 is an exploded side and bottom perspective view of the oral appliance of FIG. 1A.
Figure 5:
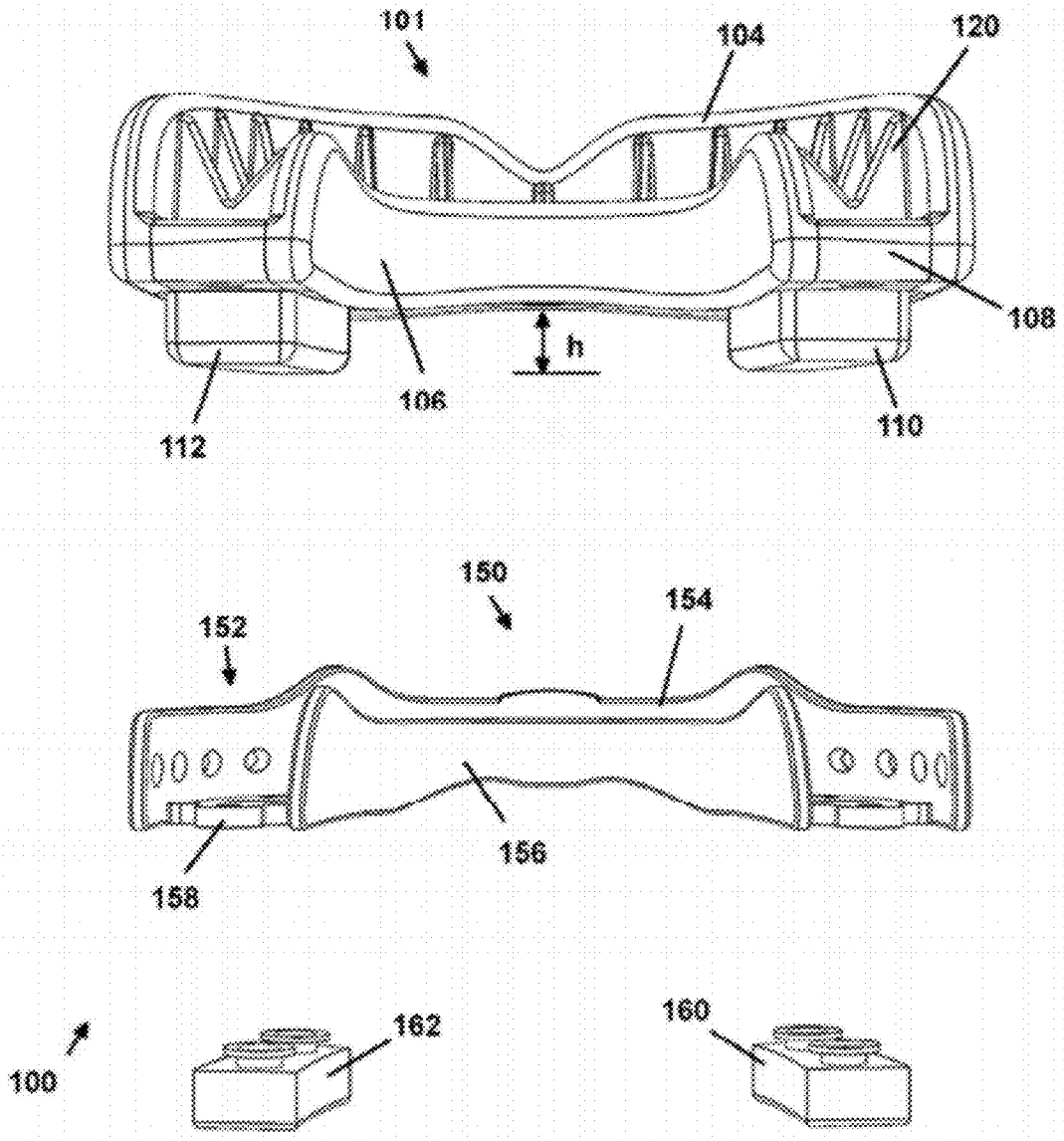
FIG. 5 is an exploded posterior view of the oral appliance of FIG. 1A.

The following description is of the best modes presently contemplated for practicing various embodiments of the present invention. The description is not to be taken in a limiting sense but is made merely for the purpose of describing the general principles of the invention. The scope of the invention should be ascertained with reference to the claims the specification and the figures. In the description of the invention that follows, like numerals or reference designators will be used to refer to like parts or elements throughout.

It has been observed that an individual's strength and balance can benefit from a relative arrangement of the upper and lower jaw that produces three physiological results: 1) an arrangement of the temporomandibular joints ("TMJ") so that compression or undesirable contact of the condyle on each side of the mandible with the trigeminal nerve (i.e. the fifth cranial nerve, CNV), and more specifically the mandibular nerve ($V_3$), is prevented or resisted, 2) relaxation of the facial muscles associated with the upper and lower jaw, and 3) arrangement of the neck such that the cervical vertebrae are aligned so that the spine is approximately erect. Typically, when an individual closes his or her mouth, the relative arrangement of the upper and lower jaw is influenced by the anatomical imperfections in the individual's bite pattern and does not produce the three beneficial physiological results. For example, when the mouth is closed, the lower jaw is commonly positioned so that the neck tends to bend forward. Further, when the mouth is closed the lower jaw is commonly positioned so that the condyles of the mandible compress the articular disc of the TMJs. Clenching of the jaws can compress the articular disc of the TMJs and apply undesirable pressure on the trigeminal nerve. Still further, when the mouth is closed, the muscles of the face are commonly placed in tension, rather than relaxed.

Referring to FIGS. 1A-8D, an embodiment of an oral appliance 100 in accordance with the present invention, is shown. The oral appliance 100 provides a pliable intermediate surface between the upper and lower jaws that partially yields to the anatomical imperfections in the individual's bite pattern to thereby encourage the lower jaw to arrange itself in a more balanced position relative to the upper jaw. The oral appliance 100 also defines a target gap between the bite surfaces of the upper and lower jaw so that the condyles of the mandible are urged away from the maxilla to decompress the articular disc of the TMJs and avoid applying undesirable pressure on the trigeminal nerve. As shown, the oral appliance 100 is also a mouth guard that covers the teeth and gums of the upper jaw to prevent and reduce injury to the teeth, arch, lip and gums, in addition to providing the other benefits described herein. In other embodiments, the oral appliance need not be a mouth guard. In other words, the bite pads, as described below, can be held in place, for example, with a wire frame in order to provide the desired spacing and positioning of the upper jaw relative to the lower jaw with the described benefits. By way of example only, the bite pads can also be held in place by the use of an orthodontic retainer.

The oral appliance 100 comprises a channel 102 formed by a lateral wall 104 connected with a lingual wall 106 by an occlusal wall 108 (also referred to herein as a base), the channel 102 being adapted to receive teeth of a user's upper jaw. The lateral wall 104 and lingual wall 106 both extend substantially along the upper dental arch of a user when placed in the mouth, thereby forming a mouth guard to protect the structures of the upper jaw from trauma delivered directly to the upper jaw, and to protect the lower jaw from trauma caused by forceful contact with the upper jaw. In some embodiments, the channel 102 can extend approximately between the two second molars of the upper jaw. By extending between the second molars and not the third molars, the oral appliance 100 can avoid potentially triggering a gag reflex in a wearer. In this configuration, bite pads 110, 112 (FIG. 3) are positioned about 11.5 mm from the posterior or distal end of the oral appliance 100. Thus, the oral appliance 100 covers the two second molars while the bite pads 110, 112 only cover the two first molar as well as the two first bicuspid and the two second bicuspid as described herein. In other embodiments, the channel can extend some other distance along the dental arch. For example, in some embodiments the channel can extend between the third molars of the dental arch. In still other embodiments, the channel can span different portions of the dental arch.

Preferably, a plurality of fins 120 are formed along the channel 102. The fins 120 and channel 102 are formed of a material that can soften upon boiling, allowing the fins 120 and the channel 102 to be deformed by the teeth of the upper jaw, so that the channel 102 acquires a seating surface that conforms to the particular dental anatomy of the user. For example, the channel 102 and the fins 120 can be formed of a thermo-plastic material such as ethylene vinyl acetate ("EVA"). Ethylene vinyl acetate is a thermo-plastic material that can be heated or boiled to soften the material and then the user can insert the appliance in his or her mouth, and bite down on the appliance in order to cause the softened appliance to permanently deform to the shape of the teeth and mouth of the user. In an embodiment, the thermoplastic material is ELVAX® 150 which has a melting point of 145° F. and a Shore A durometer of 73, or ELVAX® 250 which has a melting point of 158° F. and a Shore A durometer of 80. ELVAX® branded EVA copolymer resins are available from DUPONT®. In other embodiments, the thermo-plastic material can be some other EVA or non-EVA softenable material. The thermo-plastic material can be translucent or transparent. A translucent or transparent material can be further tinted or modified to obtain a desired appearance. Alternatively, the thermo-plastic material can be opaque, and optionally be fabricated in one or more colors or combinations of colors, as permitted by known manufacturing techniques. As shown in FIG. 1A, the thermo-plastic material is translucent, and an inner supporting frame 150, described in further detail below, can be seen through the walls.

As can be seen in FIG. 1A, a frame 150 is nested within and provides rigidity to the then over-molded thermo-plastic material 101 that forms the walls 104, 106, 108 of the channel 102. The exploded views of FIGS. 2A-5 provide unobstructed views of the frame 150, which includes a lateral frame wall 154 and a lingual frame wall 156 joined by occlusal frame sections 158. Optionally, the lateral frame wall 154 and/or the lingual frame wall 156 can have material removed to reduce the weight of the frame 150. As shown, the occlusal frame sections 158 need not span the entire length of the dental arch. The occlusal frame sections 158 are intended to connect and space the lateral frame wall 154 and the lingual frame wall 156, and to optionally provide registration and connection points for cores 160, 162 of the bite pads 110, 112 and/or skins surrounding the cores 160, 162, as explained further below. Optionally, and as shown, the frame 150 can include a mounting surface 164 for applying a graphic symbol, insignia, hologram, or other additional feature. The frame 150 can comprise a material having a higher melting temperature or softening point than the over-molded thermo-plastic material so that when the oral appliance is boiled, the frame 150 reinforces the oral appliance against undesirable and/or unintended deformation. Further, the frame 150 can comprise a material having sufficient stiffness to resist excessively and/or permanently deforming when placed in the mouth of a user and the user clenches his or her jaws. In an embodiment, the frame can comprise a copolymer material that does not include bisphenol-A (BPA). For example, in an embodiment the frame can comprise a polymer such as TRITAN™ copolyester from EASTMAN® Chemical Company. TRITAN™ EX 401 has a melting temperature of approximately 515-535° F. and a stiffness of 1500 MPa. The frame 150 and additional feature(s) can be visible through the over-molded material 101 where the thermo-plastic over-molded material 101 is a translucent or transparent material.

Preferably, when initially defining the seating surface, the user will bite down approximately to the occlusal frame sections 158 to establish a gap between the biting surface of the upper and lower jaws. As a fin 120 deforms, excess material can fill the spaces between adjacent fins 120 and a relatively deep seating surface can be formed for improved retention. Referring to FIGS. 6A-6D, the fins 120*a*-120*g* each have a rounded upper surface 121*a*-121*g* extending between a pair of sidewalls, the upper surface 121*a*-121*g* having a compound slope that can help guide teeth when the user places the oral appliance in the mouth and additionally when the user clenches his or her jaws during the deformation process for forming a seating surface of the oral appliance. The sidewalls each have a lateral portion 122*a*-122*g* and a lingual portion 124*a*-124*g* with geometries that vary relative to each other, and from the second molar to the incisors, although in other embodiments the geometries need not necessarily vary, and need not be shaped as shown in FIG. 6D. In general, the fins 120*a*-120*g* each have a V-shaped groove 123*a*-123*g* that guides an individual tooth relative to the channel 102 and relative to the spaces between fins 120*a*-120*g* so that the oral appliance 100 seats on the upper jaw of the user. The two portions of the sidewalls 122*a*-122*g* and 124*a*-124*g* meet to form the V-shaped grooves 123*a*-123*g* in the fins 120*a*-120*g* respectively. It is noted that the V-shaped grooves 123*a*-123*g* include corresponding apexes 125*a*-125*g*. As if evident from FIG. 6D, the V-shaped fins are formed to accommodate the shapes of the teeth that are seated between the adjacent fins. Thus, as the molars are larger and wider, the V-shape in the corresponding fin 120*a* is wider with the portions 122*a*, 124*a* of the sidewalls of the fin 120*a* being about the same height. As the teeth become sharper and pointed toward the central teeth, the lateral portions 122*b*-122*g* of the sidewalls of the fin 120*b*-*g* are higher than the lingual portions 124*b*-124*g* of the sidewalls. In general though, the V-shape preferably defines slightly less than a right angle. The V-shaped grooves 123*a*-123*g* enable the fins 120*a*-120*g* to better form or mold around each tooth. It is to be noted that in other embodiments the grooves can have other shapes, such as U-shapes, in order to assist in the placement and seating of the teeth relative to the oral appliance and so that the fins form or mold around each tooth. The channel 102 includes thirteen fins 120, but in other embodiments the channel can have fewer or more fins.

Figure 6A:
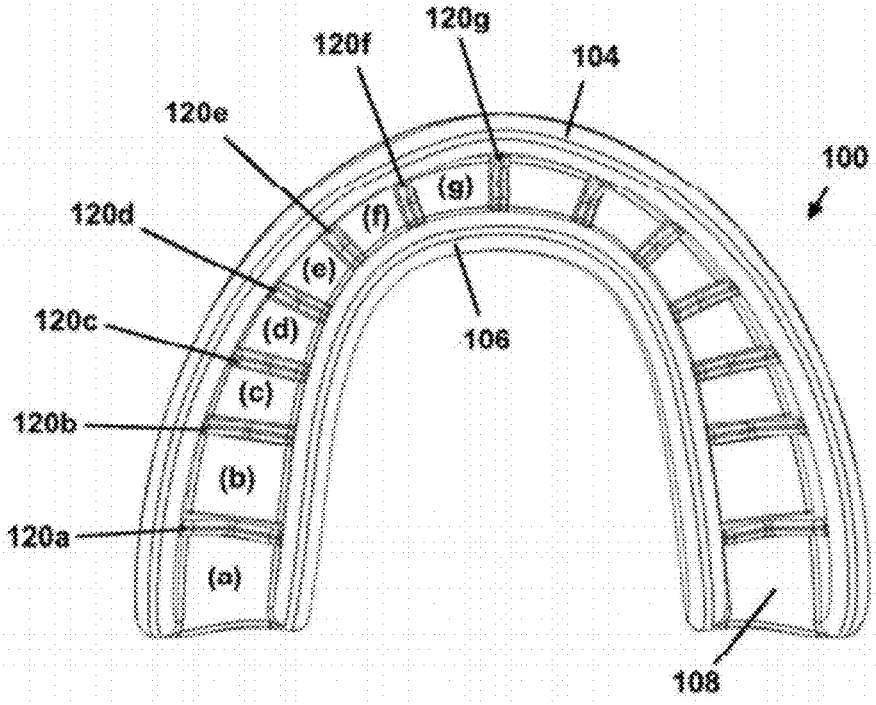
FIG. 6A is a plan view of the seating surface of the oral appliance of FIG. 1A.
Figure 6B:
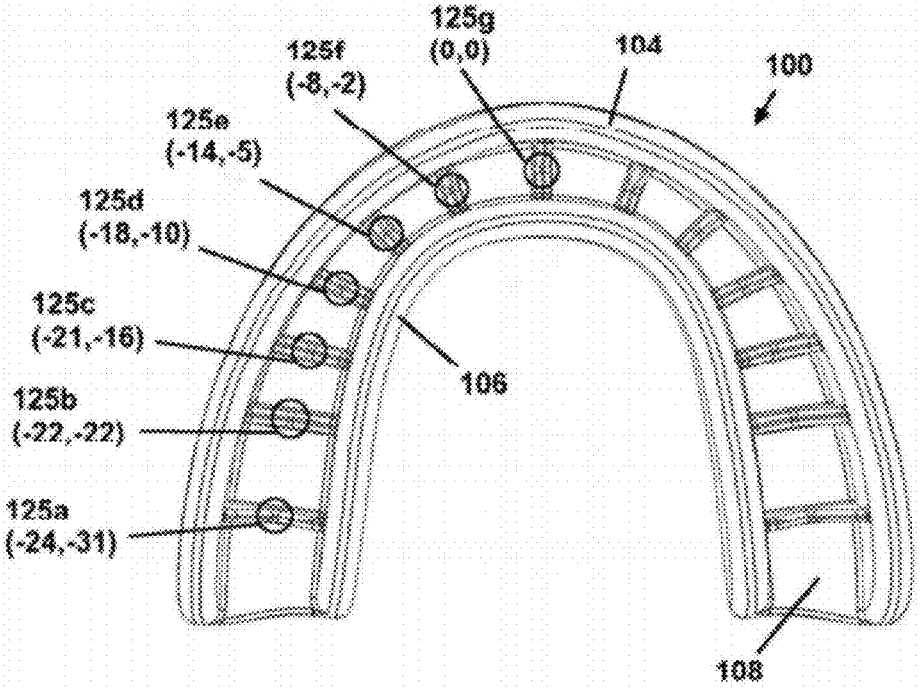
FIG. 6B is the plan view of FIG. 6A with exemplary distances of the fins of the seating surface relative to a central fin in x and y coordinates.
Figure 6C:
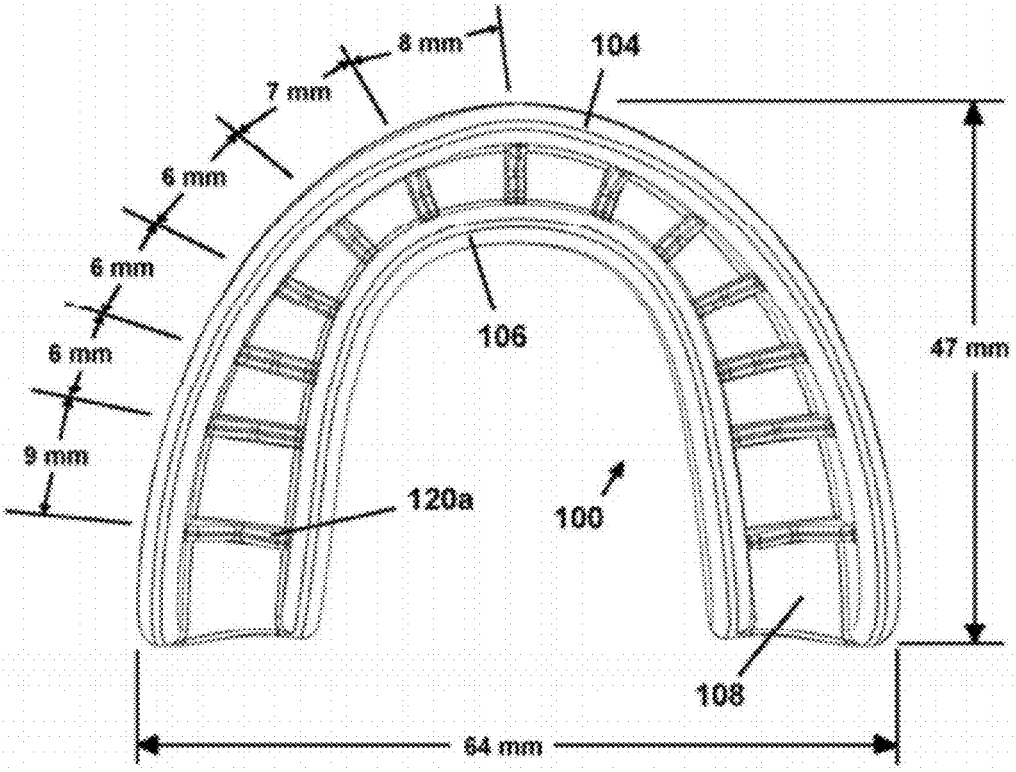
FIG. 6C is the plan view of FIG. 6A labeled with distances between fins and overall oral appliance dimensions.
Figure 6D:
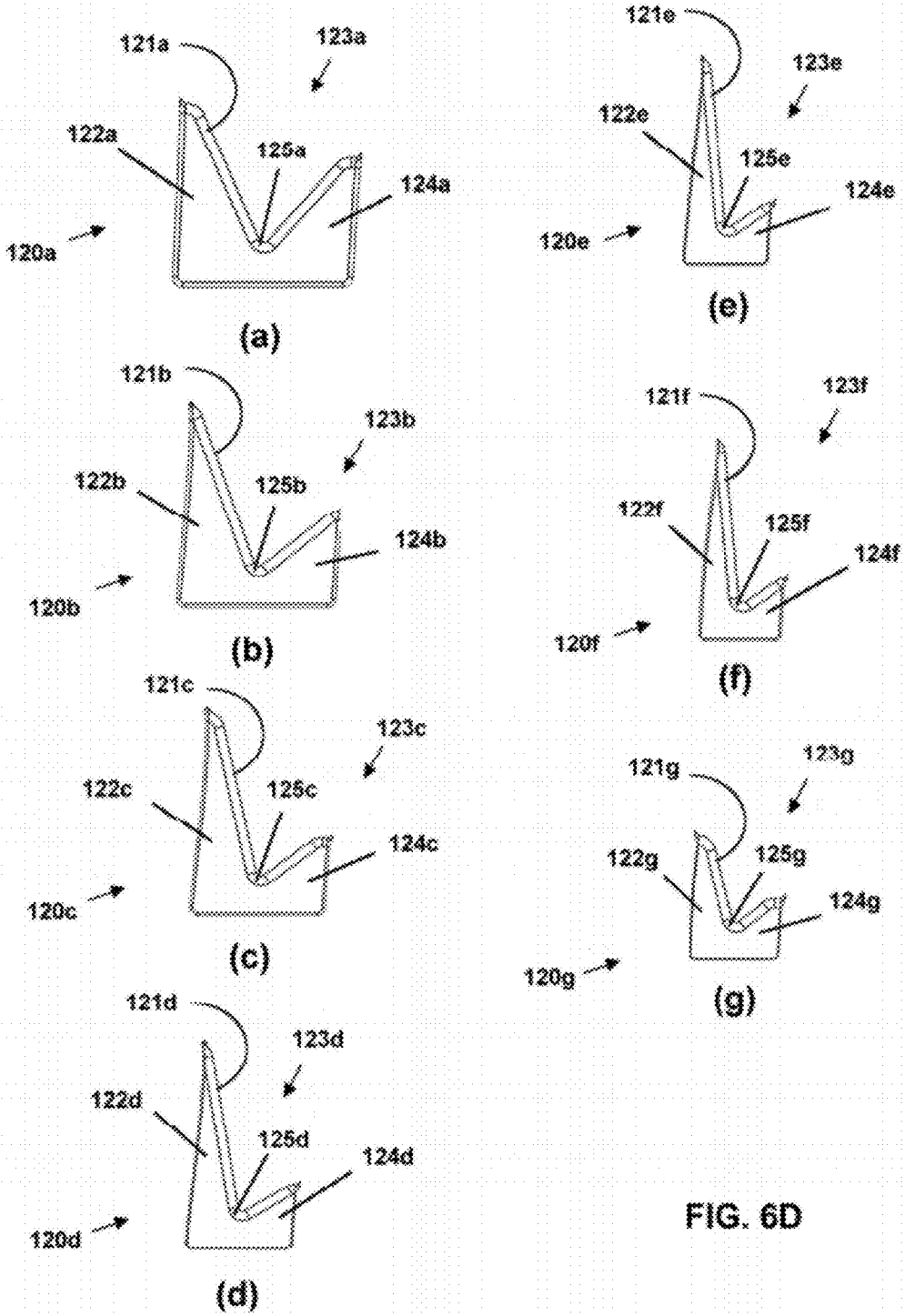
FIG. 6D is a series of isolated views of V-shaped fins of the seating surface of the embodiment of the oral appliance of FIG. 1A.

FIGS. 6A, 6B and 6C illustrate exemplary dimensions and fin spacing of the embodiment of FIG. 1A to produce a suitable seating surface for an oral appliance useable for a substantial portion of a potential user base. In FIG. 6A, space (g) is adapted to receive a central tooth of the user, space (f) is adapted to receive a lateral tooth of a user, space (e) is adapted to receive a canine of the user, spaces (d) and (c) are adapted to receive the first and second bicuspids of the user, and spaces (b) and (a) are adapted to receive the first and second molars of the user. FIG. 6B shows relative distance (in millimeters), along the x- and y-directions of the page, of the apex 125*a*-125*f* of each groove 123*a*-123*f* from the apex 125*g* of the groove 123*g* of the fin 120*g* located centrally along the dental arch. For example, the fin 120*a*, located most distally from the central fin 120*g*, has an apex 125*a* that is 24 mm to the left (from the wearer's perspective) of the groove of the central fin 120*g* and 31 mm posterior to the groove of the central fin 120*g*. FIG. 6C shows the approximate distance between fins (also in millimeters) and the overall dimensions of the oral appliance in the plane of the page. The fin spacing provided for the left side of the oral appliance is substantially mirrored along the right side of the oral appliance.

Figure 9:
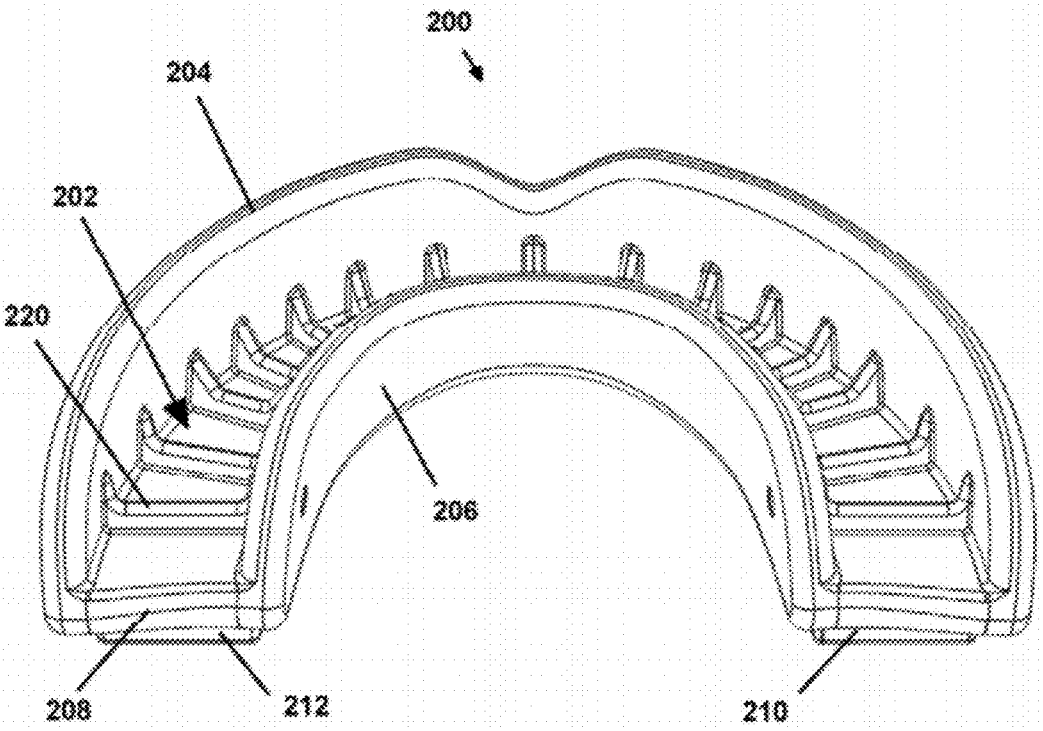
FIG. 9 is a posterior perspective view of an alternative embodiment of an oral appliance in accordance with the present invention having an alternative seating surface that is adapted to be seated on the upper jaw.

It is to be understood that embodiments of oral appliances in accordance with the present invention need not have a seating surface as shown in FIGS. 6A-6C. An alternative embodiment of an oral appliance 200, in accordance with the present invention, is shown in FIG. 9, including lateral wall 204, lingual wall 206 and occlusal wall 208 with a channel 202 being adapted to receive the teeth of a user's upper jaw. This oral appliance 200 further includes fins 220 that divide the oral appliance 200 for receiving the teeth of the user. These fins 220 have side walls and a seating surface, including a shelf 224, that is preferably about parallel to the occlusal wall 208, which shelf 224 slopes upwardly to meet the lateral wall 204 and the lingual wall 206. In still other embodiments the surface of the fin can have some other shape, such as U-shaped, for example, as indicated above.

Figure 7A:
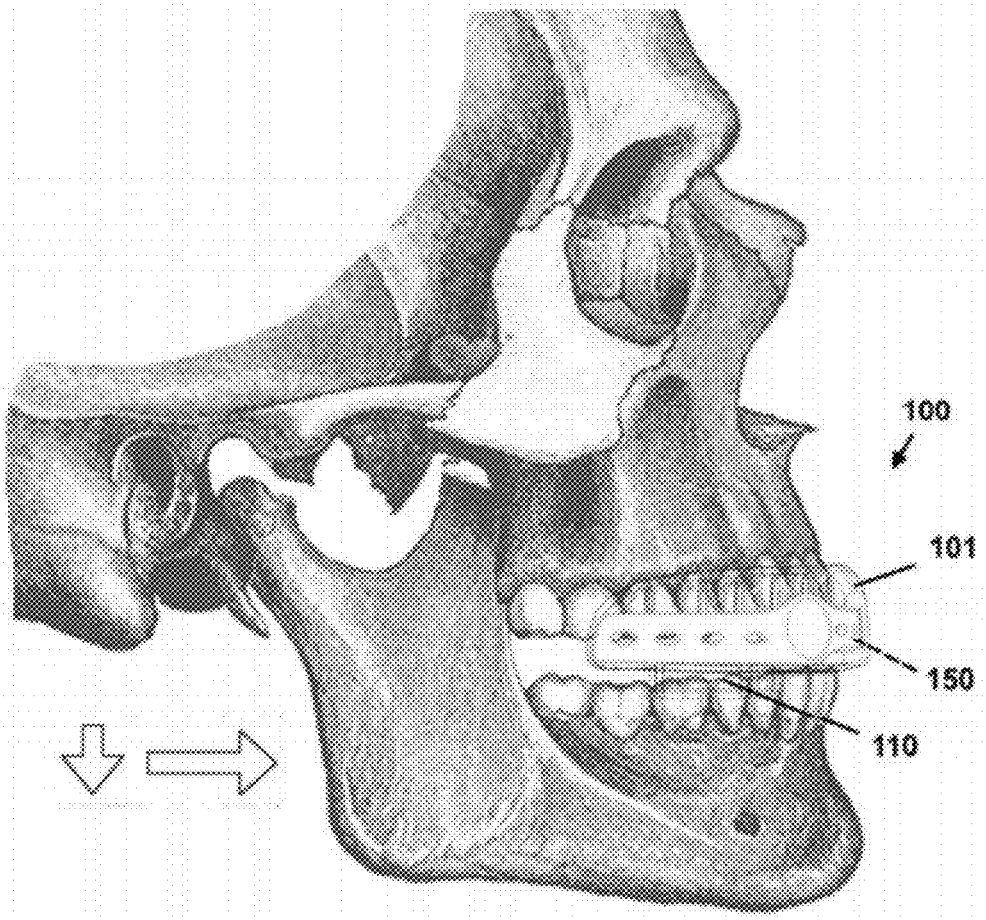
FIG. 7A is a side view illustrating positioning of the lower jaw relative to the upper jaw when the oral appliance of FIG. 1A is positioned in the mouth of a user.

Referring to FIGS. 3-5 and 7A-8F, the bite surface of the upper teeth is separated from the bite surface of the lower teeth by a gap defined by the thickness of the occlusal frame sections 158 and the compressed thickness of bite pads 110, 112 extending caudally from the surface of the occlusal wall 108 opposite the channel 102. As shown in FIGS. 7A and 7B, the bite pads 110, 112 extend preferably and approximately from the first molar to the first bicuspid on opposite sides of the upper jaw, although in other embodiments, the bite pads 110, 112 can extend along other portions of the dental arch. For example, in an embodiment, the bite pads 110, 112 can extend from the second molar to the second bicuspid.

Generally, the bite pads 110, 112 can be formed of any material that allows sufficient support during maximum compression and sufficient yield to the teeth of the lower jaw such that the lower jaw is free to reposition itself to a location of minimum stress. The bite pads 110, 112 are elastic, and, preferably, can comprise a pliable skin or shell filled with a fluid. As shown in FIGS. 1B-8F, the bite pads 110, 112 each include a core 160, 162 encapsulated by a skin, which is optionally further encapsulated by the over-molded material 101. The bite pads 110, 112 can include features that mate or register with the occlusal frame sections 158. Alternatively, the bite pads 110, 112 can be arranged relative to the frame 150 by a mold or jig. In one embodiment, the skin can comprise a silicone shell that defines a space that is filled with silicone gel. The silicone gel can have a Shore OO durometer of 50, for example. The silicone shell can have a Shore A durometer between 50 and 70, for example. Silicone has a melting point of 280° F. and a silicone shell would resist melting during boiling. In still other embodiments, the bite pads 110, 112 can comprise some other fluid. The fluid placed in the bite pads can be a liquid and also can be a gas. Additionally, the fluid can be a polymer that flows to perform the functions described herein. Thus, generally the bite pads can be liquid filled, air or gas filled or filled with a soft material such as a gel. Alternatively, the bite pads can be a flowable or deformable solid that may or may not be held within a pliable shell. Alternatively, the bite pads can be a composite material with different dampening properties that result based on the compression force. The bite pads can be made of a material that retains its properties without deformation at high temperatures, thereby permitting deformation of the fins 120, 120' and channel 102, as shown in FIGS. 8A-8D, when the fins 120, 120' and channel 102 are softened by heating (for example, by boiling) without suffering permanent or undesirably excessive deformation of the bite pads 110, 112. Alternatively, the seating surface of the oral appliance can be defined by heating, deformation, and subsequent cooling, before the bite pads are attached to the occlusal wall. In some embodiments, the bite pads can be separately attached by a manufacturer or a user, for example, using adhesives or some other coupling mechanism.

The bite pads 110, 112 deform and displace around the teeth as the bite surface of the lower jaw contacts the bite pads 110, 112. The bite pads 110, 112 sufficiently yield to the teeth to allow the teeth to contact the bite pads 110, 112, without regard to the shape of the surface of the teeth. The lower jaw is, thus, allowed to find a balanced position relative to the upper jaw which will correspond to a position at which the facial muscles are generally at minimal tension. It has been observed that the lower jaw is naturally urged forward relative to the upper jaw in this position. This motion and the position of the lower jaw generally tend to urge the neck backward so that the cervical vertebrae substantially align, thereby facilitating an erect spine. The compliant property of the bite pads 110, 112 further allow slippage and repositioning of the upper and lower jaws relative to one another to adjust for changes in facial muscle tension, for example, when the head is turned to face the side of a user's body, or when a user is off-balance. The bite pads adjust relative to each other during uneven teeth clenching to provide the benefits derived herein.

Figure 8A:
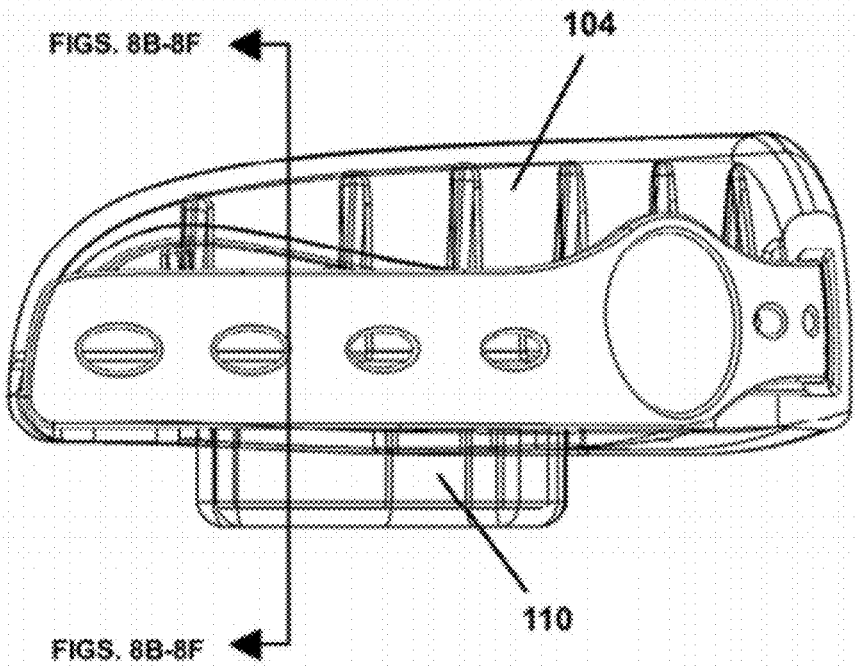
FIG. 8A is a side view of the oral appliance of FIG. 1A.
Figure 8B:
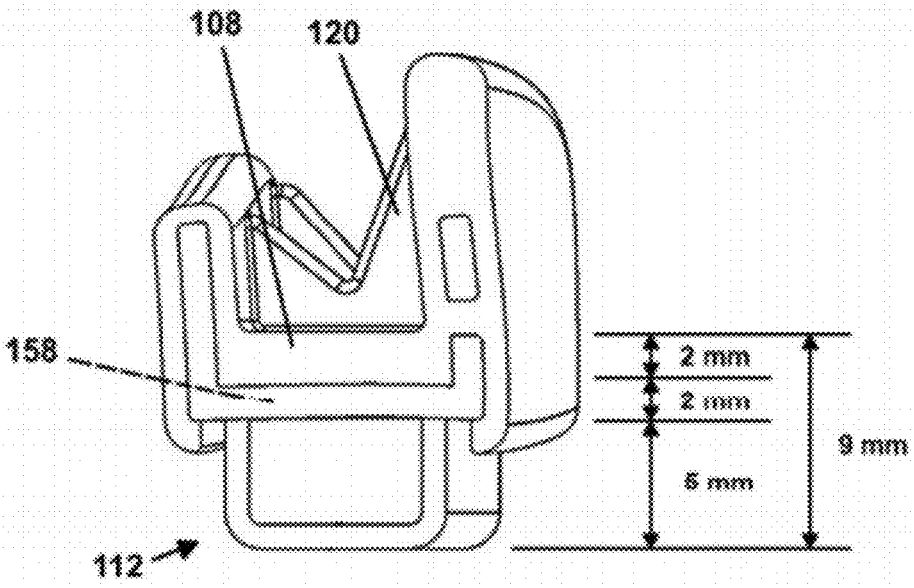
FIG. 8B is a cross-sectional anterior view of the left side of the oral appliance of FIG. 1A showing exemplary thickness dimensions.
Figure 8C:
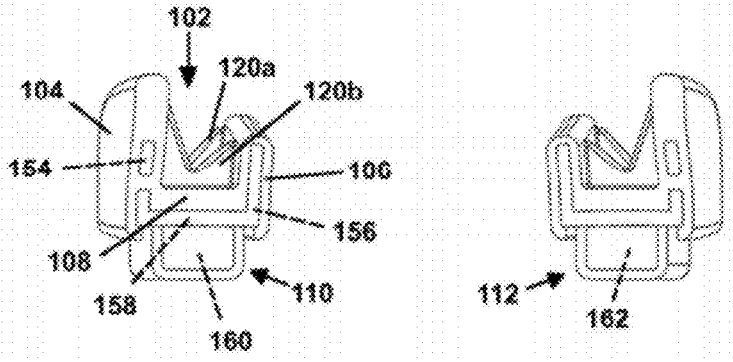
FIGS. 8C-8F are cross-sectional anterior views illustrating the deformation mechanics of the oral appliance of FIG. 1A.
Figure 8D:
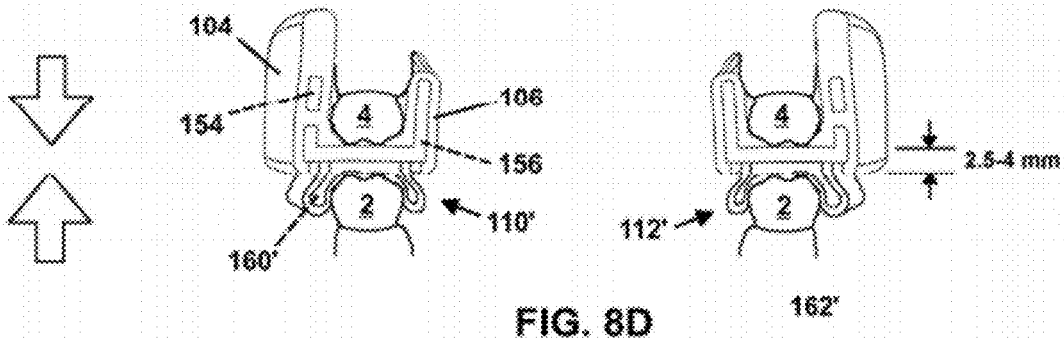
Figure 8E:
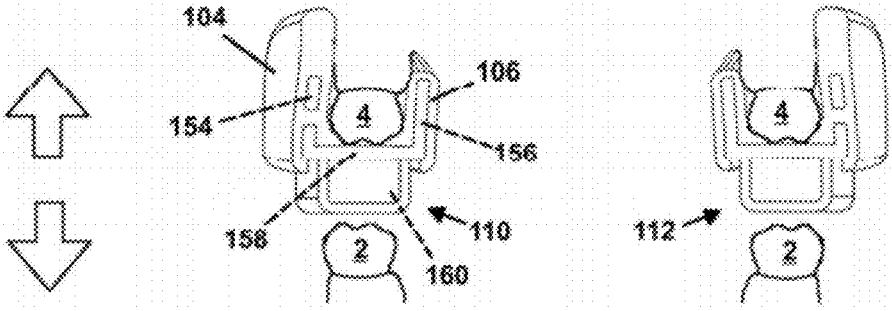
Figure 8F:
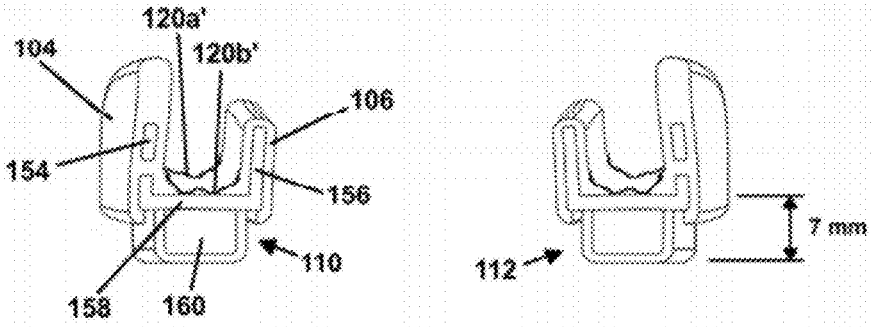

FIG. 8A is a side view of the oral appliance of FIG. 1A showing an approximate location along the oral appliance of cross-sections FIGS. 8B-8F. FIG. 8B illustrates exemplary thickness dimensions of an undeformed seating surface of the oral appliance. Preferably, in an undeformed state, the occlusal wall 108 and occlusal frame section 158 are each approximately 2 mm thick, and the bite pad 112 extends below the occlusal frame section 158 by about 5 mm. FIG. 8C depicts a cross-sectional anterior view of the oral appliance 100 about in the location of a first molar. FIG. 8D depicts a cross-section view similar to FIG. 8C showing teeth 2, 4 of the upper and lower jaw positioned when the oral appliance is fitted in the mouth of a user with the upper and lower jaw closed. As can be seen, the bite pads 110', 112' deform around the teeth of the lower jaw until the teeth seat and the bite pads 110', 112' reach maximum deformation, creating a cushion of fluid that, along with the occlusal frame sections 158, defines the gap between the teeth 2, 4. The gap is targeted to a range of between 2 mm and 7 mm. Preferably, the gap is 2.5 mm to 4 mm. More preferably, the gap is 2.5 mm to 3 mm. The gap can vary with the individual user and with an applied clenching force. The gap can also be deliberately varied by the manufacturer to accommodate different applications or patient response. It has been observed that a gap of between 2 mm and 7 mm can result, for a substantial portion of a potential user base, in separation of the condyles of the mandible away from the maxilla and decompression of the articular disc, and further avoids contact between the TMJs and nerves associated with the TMJs. The benefits of the gap include the alignment of the user's spine which preferably allows the user to have increased strength and balance while performing normal day to day activities and also when participating in sporting events, and, in particular, in team sports and contact sports. FIG. 8E shows the upper teeth held in the oral appliance 100 with the upper and lower jaws open. FIG. 8F shows that, with the upper teeth removed, the fins 120 and the oral appliance 100 retain the shape of the teeth.

Figure 7B:
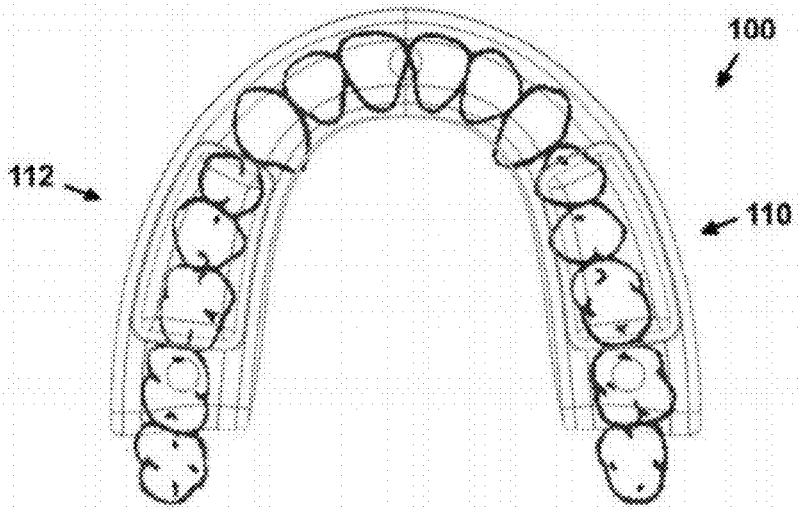
FIG. 7B is a bottom view of an outline of the oral appliance with the oral appliance seated on the upper dental arch.

As has been described above, the oral appliance produces the three physiological results that can benefit a user's strength and balance. The embodiment of FIGS. 1-8F further acts as a mouth guard to protect the teeth, arch, lip and gums. It has been observed that during intense physical activity, a user or wearer of a conventional mouth guard will remove the mouth guard to prevent obstruction of the air passageway of the mouth. As can be seen particularly in FIGS. 5 and 7A, the oral appliance 100 further provides unobstructed breathing as a result of the space between the upper and lower jaws, formed by the bite pads 110', 112'. To further increase the air passageway there is a gap height h (FIG. 5) beneath the oral appliance at the anterior end of the appliance 100. Also, the lingual wall 106 of the oral appliance 100 has a slightly thinner, and curved, occlusal wall portion 108. FIG. 7A specifically illustrates the oral appliance 100 fitted in the mouth of a user. As can be seen, the condyle of the TMJ is gapped as the lower jaw is shifted down and forward (i.e., to the right on the page). The oral appliance 100 comprises a translucent over-molded material 101 encapsulating the frame 150 with a bite pad 110 partially collapsed so that a gap between the bite surfaces of the upper and lower jaws is maintained within a target range. FIG. 7B shows the upper dental arch within the channel of the oral appliance 100. The frame is removed from the view so that the dental arch can be clearly seen through the translucent over-molded material. As can be seen, the bite pads 110, 112 span the dental arch from the first bicuspid to the first molar on opposite sides of the jaw.

Referring to FIGS. 10A-21F, an alternative embodiment of an oral appliance 300 in accordance with the present invention is shown. The oral appliance of this embodiment is preferably worn by users that are playing individual sports or non-contact sports such as, for example, golf and tennis. The oral appliance 300 comprises left and right channels 302 that are formed by lateral walls 304 connected with lingual walls 306 by occlusal walls 308, the left and right channel 302 being adapted to receive some of the teeth of a user's lower jaw. The left and right channels 302 approximately mirror each other, though in other embodiments the left and right channels can differ in shape. In some embodiments, the left and right channels 302 can extend approximately between the first molar and the first bicuspid on each side of the lower jaw. Thus, the oral appliance covers the second molars while the bite pad only covers the first molar as well as the first and second bicuspids as described herein.

The left and right channels 302 each include four fins 320*a*-320*d* that deform along with a portion of the channel 302 to define a seating surface for the teeth of the lower jaw. Bite pads 310, 312 are pliable and yield to the teeth of the upper jaw so that the lower jaw can find a point of minimum tension in the facial muscles. The left and right channels 302 are connected by a wire 330 that extends along the outer surface (i.e., the lateral wall) of the lower dental arch, although in other embodiments, the wire can extend along the lingual wall of the dental arch. The bite pads 310, 312 have similar shape, dimensions, materials, design and function as the bite pads previously described. The oral appliance 300 defines a target gap between the bite surfaces of the upper and lower jaw so that the condyles of the mandible are urged away from the maxilla to decompress the articular disc of the TMJs and avoid applying undesirable pressure on the trigeminal nerve. As shown in the oral appliance 300, the bite pads 310, 312 as described below, can be held in place with a frame 350 having two portions connected by the wire 330, for example, in order to provide the desired spacing and positioning of the upper jaw relative to the lower jaw with the described benefits. In an embodiment, the wire can comprise braided strands of stainless steel. The wire can be flexible or semi-flexible. Alternatively, the wire can comprise a single piece of metal and can be flexible, semi-flexible, or rigid. By way of example only, the wire can resemble a wire as used in a Hawley style orthodontic retainer.

Figure 10A:
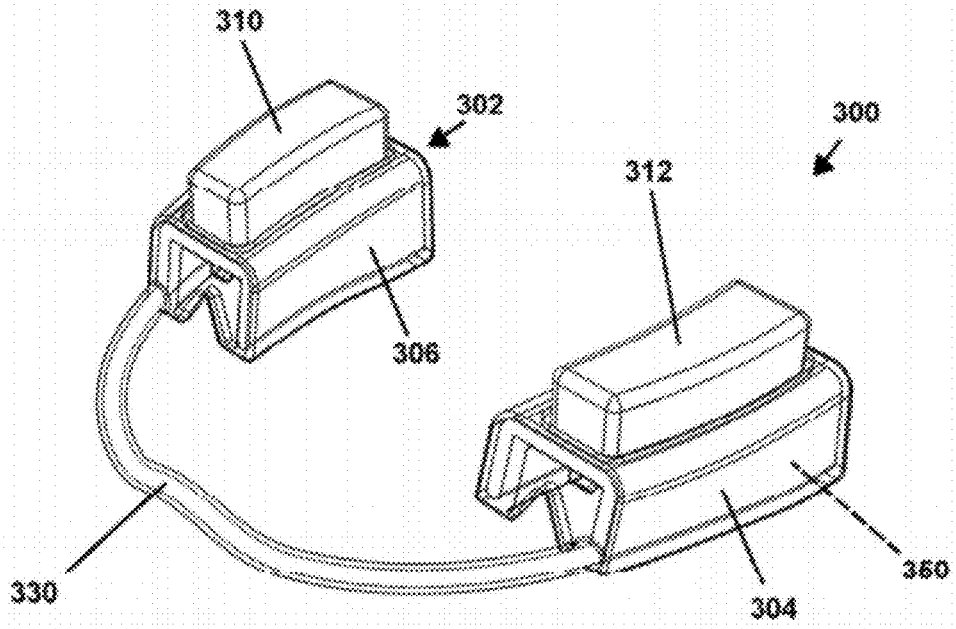
FIG. 10A is an anterior top perspective view of an alternative embodiment of an oral appliance in accordance with the present invention that is adapted to be seated on the lower jaw and having a translucent over-molded material.
Figure 10B:
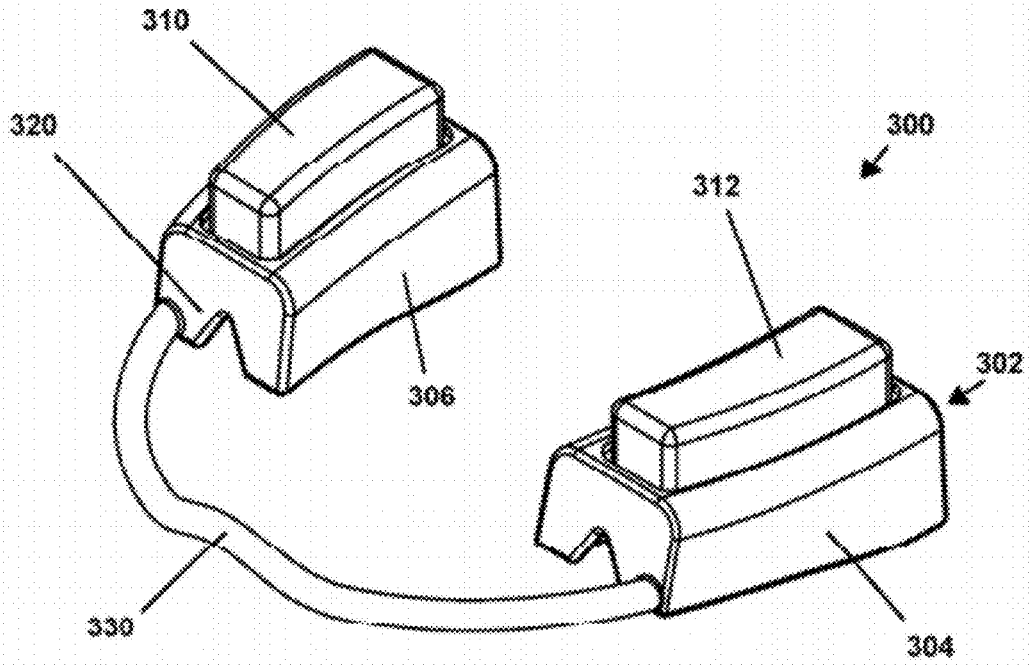
FIG. 10B is an anterior top perspective view of the oral appliance of FIG. 10A having an opaque over-molded material.

As above, the fins 320 and channels 302 are formed of a material that can soften upon boiling, allowing the fins 320 and channel 302 to be deformed by the teeth of the lower jaw, so that the channel 302 acquires a seating surface that conforms to the particular dental anatomy of the user. For example, the channel 302 and the fins 320 can be formed of a thermo-plastic material such as EVA. As previously described, EVA is a thermo-plastic material that can be heated or boiled to soften the material and then the user can insert the appliance in his or her mouth and bite down on the appliance in order to cause the softened appliance to permanently deform to the shape of the teeth and mouth of the user. In an embodiment, the thermoplastic material is ELVAX® 150 which has a melting point of 145° F. and a Shore A durometer of 73, or ELVAX® 250 which has a melting point of 158° F. and a Shore A durometer of 80. ELVAX® branded EVA copolymer resins are available from DUPONT®. In other embodiments, the thermo-plastic material can be some other EVA or non-EVA softenable material. The thermo-plastic material can be translucent or transparent. A translucent or transparent material can be further tinted or modified to obtain a desired appearance. Alternatively, the thermo-plastic material can be opaque, and optionally be fabricated in one or more colors or combinations of colors, as permitted by known manufacturing techniques. As shown in FIG. 10A, the thermo-plastic material is translucent, and an inner supporting frame 350, described in further detail below, can be seen through the walls.

Figure 10C:
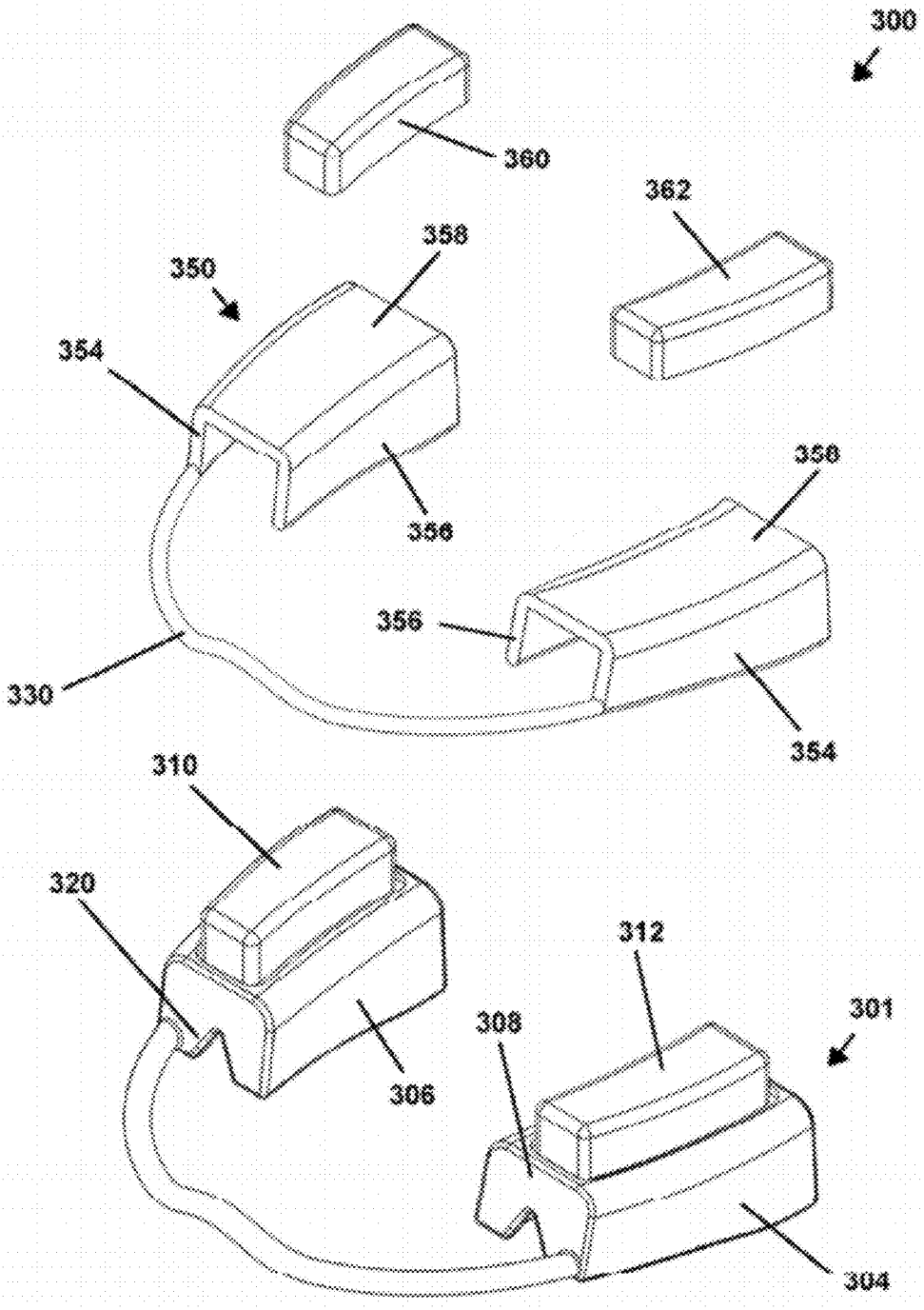
FIG. 10C is an exploded anterior top perspective view of the oral appliance of FIG. 10A.
Figure 11:
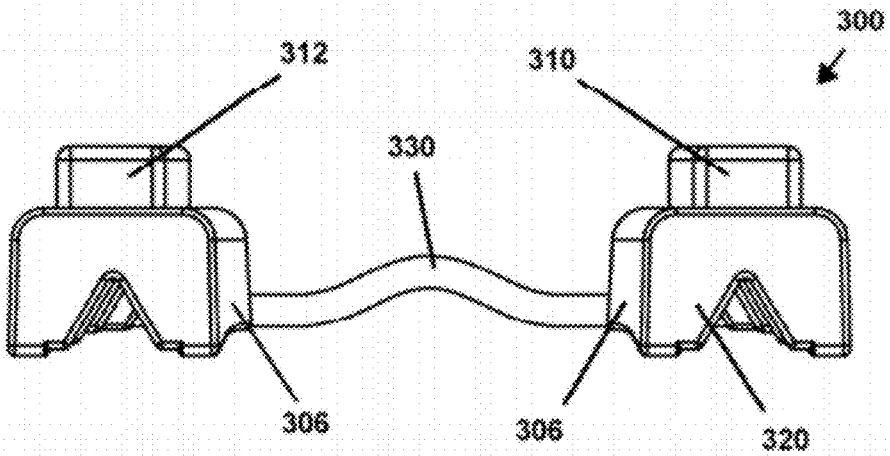
FIG. 11 is a posterior view of the embodiment of the invention of FIG. 10A.
Figure 12:
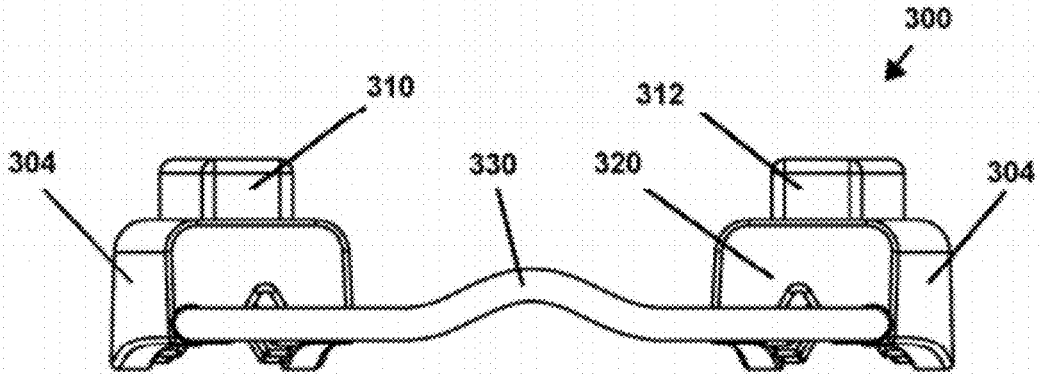
FIG. 12 is an anterior view of the embodiment of the invention of FIG. 10A.

As can be seen in FIGS. 10A and 10C, the two portions of the frame 350 are connected by the wire 330, but alternatively the portions can be connected by exposed portions of the frame 350, such as the lateral frame walls 354 and/or the lingual frame walls 356. In the embodiment shown, a wire 330 is used to provide a structure that is more rigid than the frame 350 and which provides a gripping structure similar to that of a retainer or other mouth piece. The wire 330 can be coated in a thermo-plastic material to prevent the contacting of cold metal with the user's mouth. The frame 350 is nested within and provides rigidity to the over-molded thermo-plastic material 301 that forms the walls 304, 306, 308 of the left and right channels 302. The exploded view of FIG. 10C provides an unobstructed view of the frame 350, which includes lateral frame walls 354 and lingual frame walls 356 joined by occlusal frame sections 358. The occlusal frame sections 358 are intended to connect and space the lateral frame walls 354 and the lingual frame walls 356 and to optionally provide registration and connection points for the inner components 360, 362 of the bite pads 310, 312, as explained further below. The frame 350 can comprise a material having a higher temperature melting or softening point than the over-molded material so that when the oral appliance is boiled, the frame 350 reinforces the oral appliance against undesirable and/or unintended deformation. Further, the frame 350 can comprise a material having sufficient stiffness to resist excessively and/or permanently deforming when placed in the mouth of a user and the user places the oral appliance in the mouth and additionally when the user clenches his or her jaws. In an embodiment, the frame can comprise a copolymer material that does not include bisphenol-A (BPA). For example, in an embodiment the frame can comprise a polymer such as TRITAN™ copolyester from EASTMAN® Chemical Company. TRITAN™ EX 401 has a melting temperature of approximately 515-535° F. and a stiffness of 1500 MPa. The frame 350 and additional feature(s) can be visible through the over-molded material where the thermo-plastic over-molded material is a translucent or transparent material.

Figure 13:
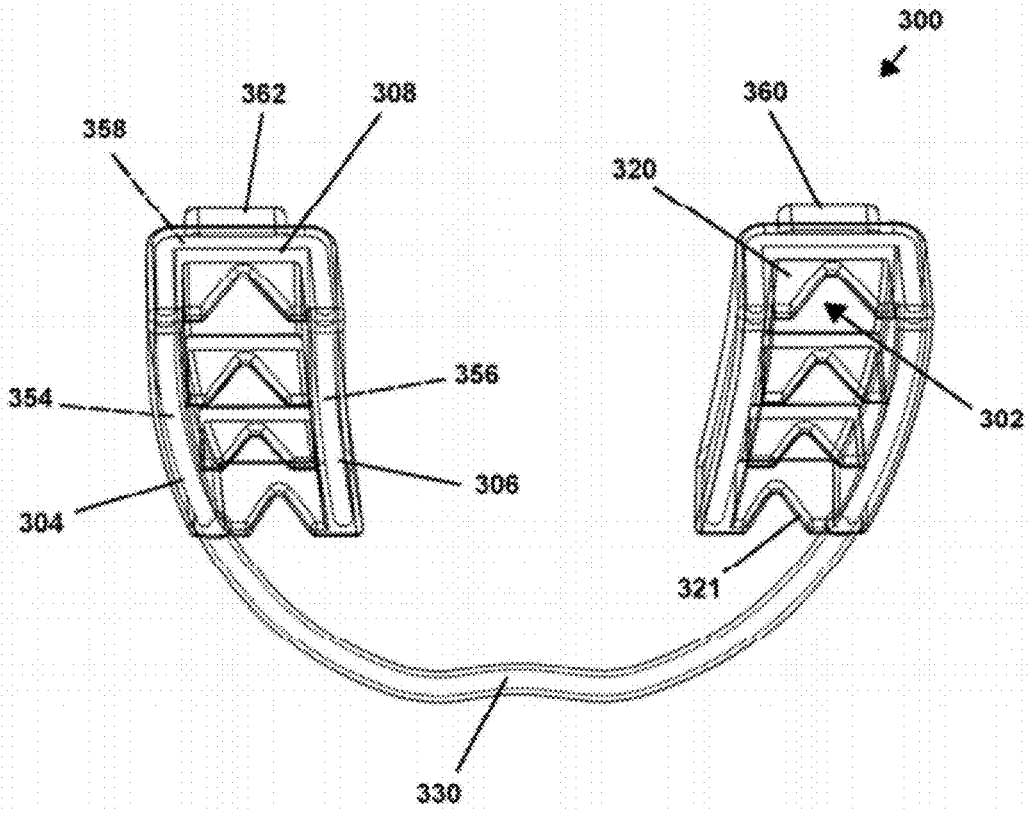
FIG. 13 is a posterior bottom perspective view of the oral appliance of FIG. 10A.
Figure 14:
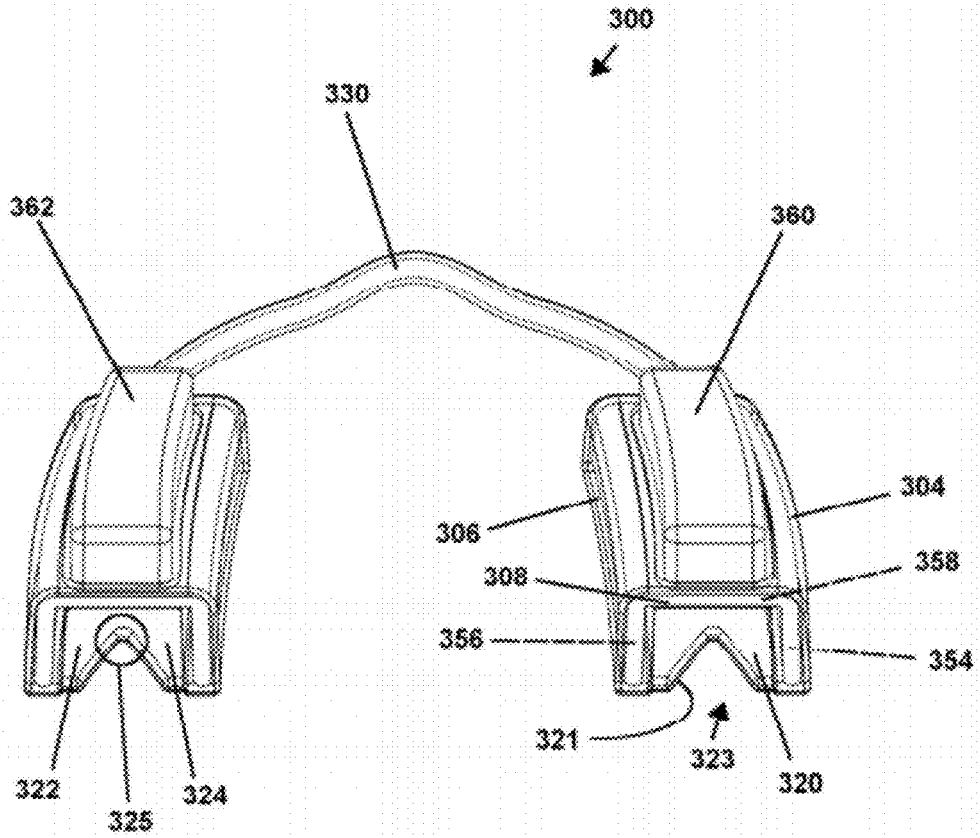
FIG. 14 is a posterior top perspective view of the embodiment of the oral appliance of FIG. 10A.

Preferably, when initially defining the seating surface, the user will bite down approximately to the occlusal frame sections 358 to establish a gap between the biting surface of the upper and lower jaws. As a fin 320 deforms, excess material can fill the spaces between adjacent fins 320 and a relatively deep seating surface can be formed for improved retention. Referring to FIGS. 13 and 14, the fins 320 each have a rounded upper surface 321 with sloped sidewalls 322, 324 that can help guide teeth during the deformation process for forming a seating surface of the oral appliance. The sidewalls each have a lateral portion 322 and a lingual portion 324 with geometries that vary relative to each other, and from the second molar to the incisors, although in other embodiments the geometries need not necessarily vary, and need not be shaped as shown in FIG. 13. In general, the fins 320 have a V-shaped groove 323 that guides an individual tooth relative to the channel and the spaces (a) to (c) (FIG. 15) that the oral appliance 300 seats relative to the lower jaw of the user. The channel 302 includes four fins 320*a*-320*d* (FIG. 17), but in other embodiments the channel can have fewer or more fins. The lateral and lingual portions of the sidewalls 322, 324 meet to form said V-shaped grooves 323 in the fins 320*a*-320*c*. It is noted that the V-shaped grooves include apexes 325 (FIG. 14). As is evident from FIG. 13 the V-shaped fins are formed to accommodate the shapes of the teeth that are seated between the adjacent fins. Thus, as the molars are larger and wider the V-shape in the fins is wider with the lingual and lateral portions of the fins 322, 324 being about the same height. In general though, the V-shape preferably defines slightly less than a right angle. The V-shaped grooves enable the fins to better form or mold around each tooth. It is to be noted that in other embodiments the grooves can have other shapes such as U-shapes in order to assist in the placement and the seating of the teeth relative to the oral appliance and so that the fins form or mold around each tooth.

Figure 15:
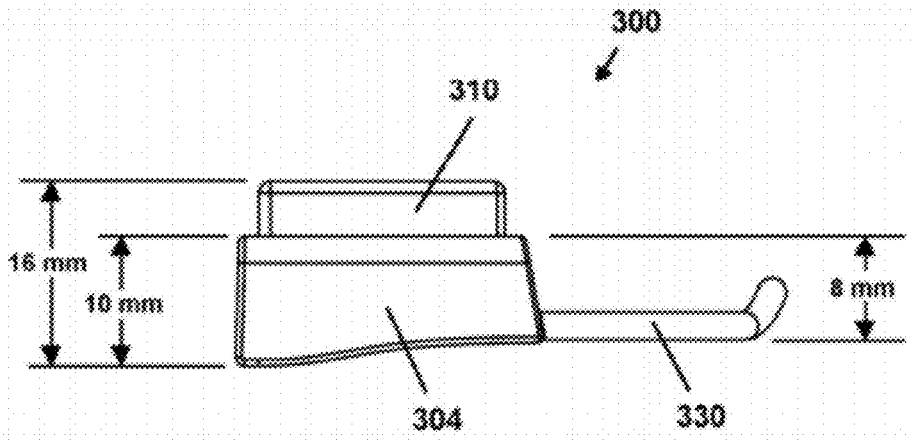
FIG. 15 is a side view of the oral appliance of FIG. 10A with exemplary dimensions.
Figure 16:
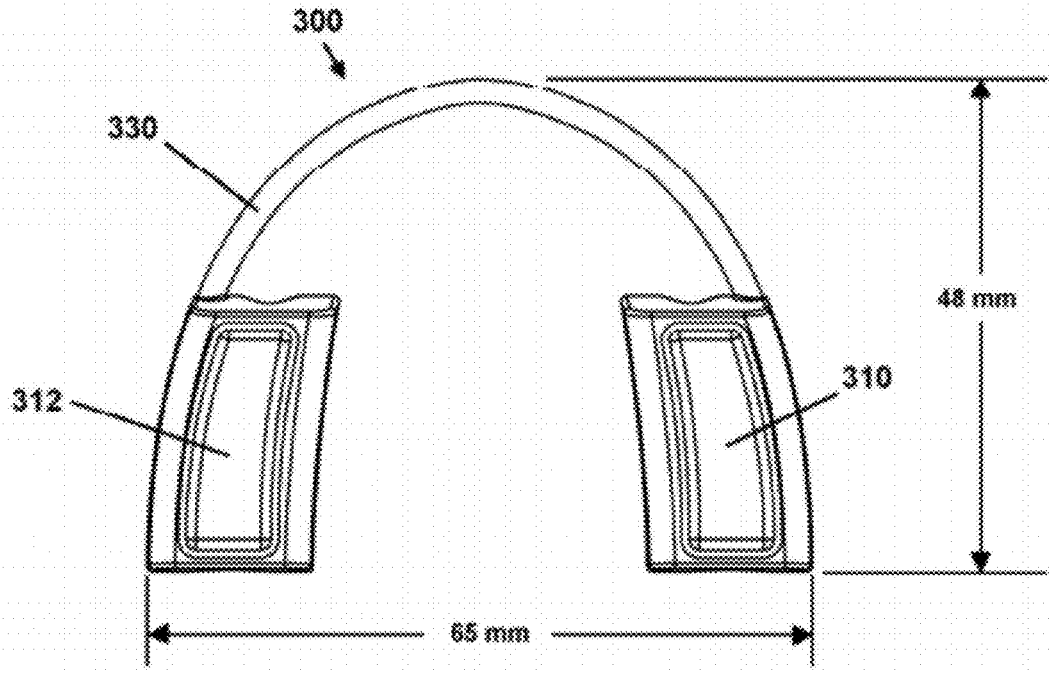
FIG. 16 is a top view of the oral appliance of FIG. 10A with exemplary dimensions.
Figure 17:
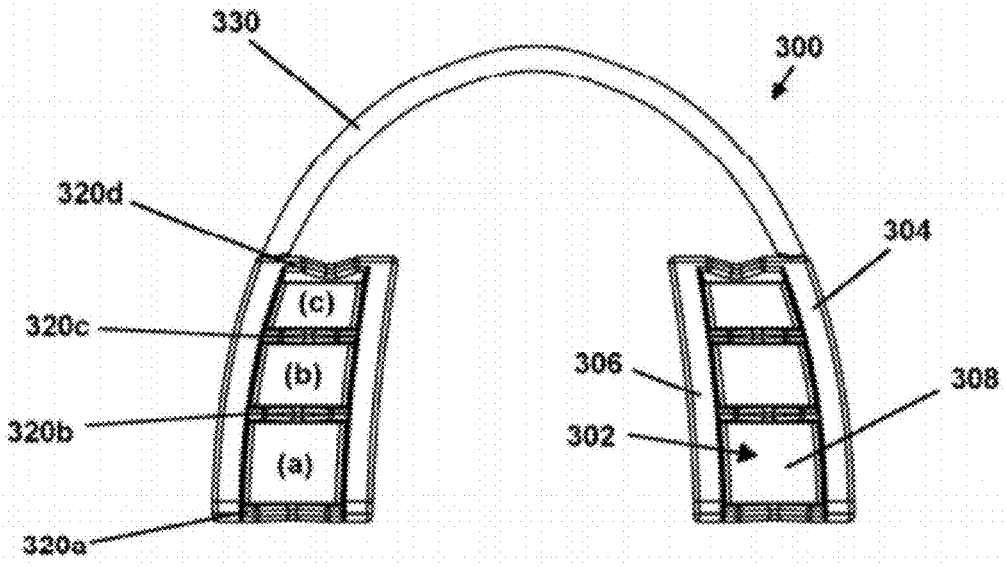
FIG. 17 is a plan view of the seating surface of the oral appliance of FIG. 10A.
Figure 18:
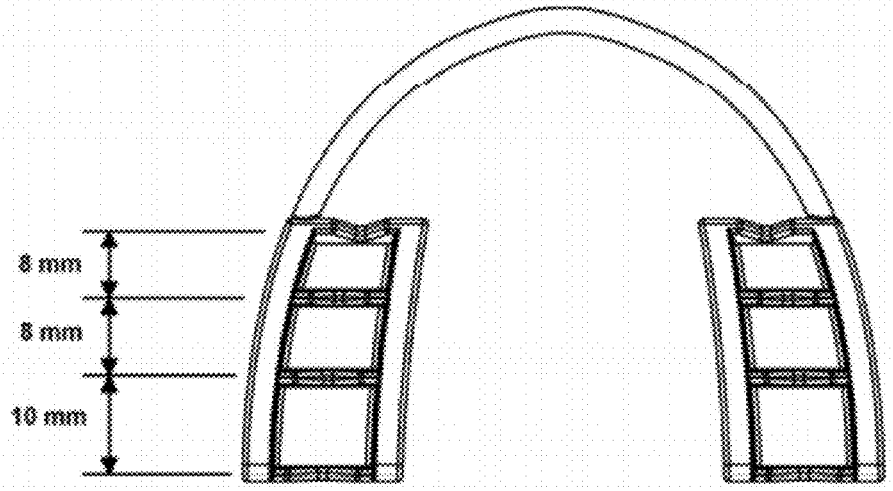
FIG. 18 is the plan view of FIG. 17 labeled with distances between fins.
Figure 19:
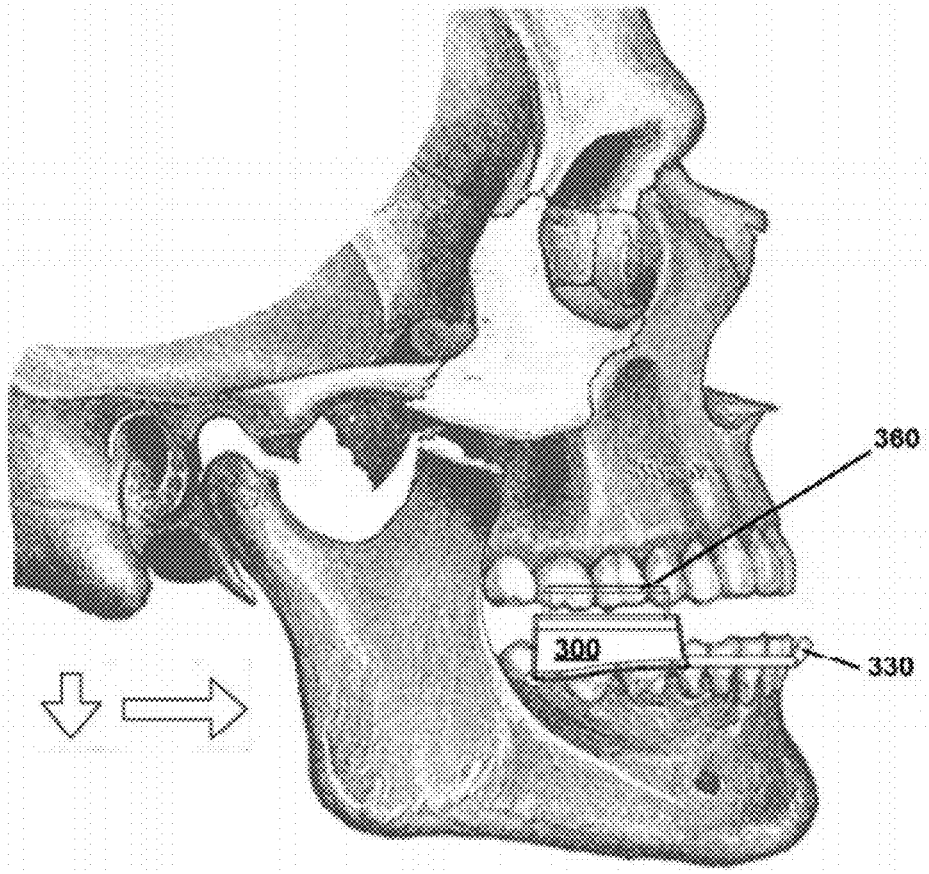
FIG. 19 is a side view illustrating positioning of the lower jaw relative to the upper jaw when the oral appliance of FIG. 10A is positioned in the mouth of a user.
Figure 20:
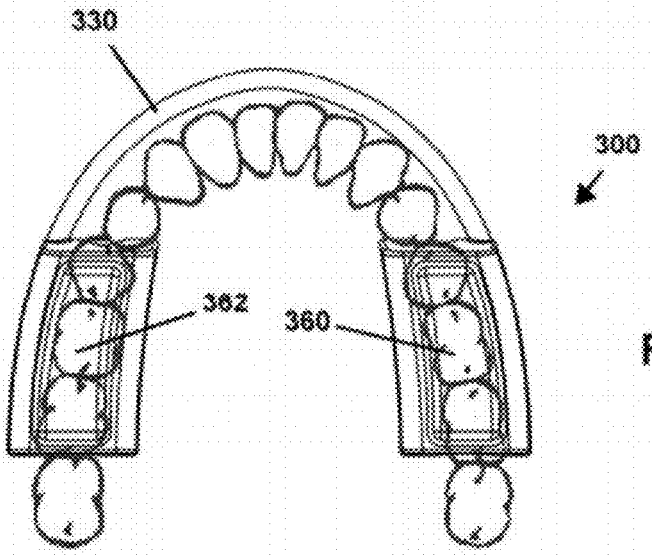
FIG. 20 is a top view of an outline of the embodiment of the invention of FIG. 10A when the oral appliance is seated on the lower jaw.

FIGS. 15 and 16 illustrate exemplary dimensions of the oral appliance 300 of FIG. 10A. FIGS. 17 and 18 illustrate dimensions and fin spacing of the embodiment of FIG. 10A, to produce a suitable seating surface for an oral appliance useable for a substantial portion of a potential user base. In FIG. 17, spaces (c) and (b) are adapted to receive the first and second bicuspids of the user, and space (a) is adapted to receive the first molar of the user. FIG. 18 shows distance between fins (also in millimeters) and overall dimensions of the oral appliance in the plane of the page. The fin spacing provided for the left side of the oral appliance is substantially mirrored along the right side of the oral appliance.

Referring to FIGS. 10A-21F, the bite surface of the upper teeth is separated from the bite surface of the lower teeth by a gap defined by the thickness of the occlusal frame sections 358 and the compressed thickness of bite pads 310, 312 extending cranially from the surface of the occlusal wall 308 opposite the channel 302. As shown in FIGS. 10A-21F, the bite pads 310, 312 extend preferably and approximately from the first molar to the first bicuspid on opposite sides of the lower jaw, although in other embodiments the bite pads 310, 312 can extend along other portions of the dental arch. For example, in an embodiment, the bite pads 310, 312 can extend from the second molar to the second bicuspid.

As above, the bite pads 310, 312 can be formed of any material that allows sufficient support during maximum compression and sufficient yield to the teeth of the upper jaw such that the lower jaw is free to reposition itself to a location of minimum stress. The bite pads 310, 312 are elastic, and, preferably, can comprise a pliable shell filled with a fluid. As shown in FIGS. 10A-21F, the bite pads 310, 312 each include a core 360, 362 encapsulated by a skin, which is optionally encapsulated by the over-molded material. The bite pads 310, 312 can include features that mate or register with the frame 350 so that when thermo-plastic material is molded around the frame 350, and optionally around the bite pads 360, 362, relative spacing of the components is predictably defined. Alternatively, the bite pads 310, 312 can be arranged relative to the frame 350 by a mold or jig. In one embodiment, the skin can comprise a silicone shell that defines a space that is filled with silicone gel. The silicone gel can have a Shore OO durometer of 50, for example. The silicone shell can have a Shore A durometer between 50 and 70, for example. Silicone has a melting point of 280° F. and a silicone shell would resist melting during boiling. In other embodiments, the bite pads 310, 312 can comprise some other fluid. The fluid placed in the bite pads can be a liquid and also can be a gas. Additionally, the fluid can be a polymer that flows to perform the functions described herein. Thus, generally the bite pads can be liquid filled, air or gas filled or filled with a soft material such as silicone or a gel. Alternatively, the bite pads can be a flowable or deformable solid that may or may not be held within a pliable shell. Alternatively, the bite pads can be a composite material with different dampening properties that results based on the compression force. The bite pads can be made of a material that retains its properties without deformation at high temperatures, thereby permitting deformation of the fins 320, 320' and the channels 302, as shown in FIG. 21A-21F, when the fins 320, 320' and channels 302 are softened by heating (for example, by boiling) without suffering permanent or undesirably excessive deformation of the bite pads. Alternatively, the seating surface of the oral appliance can be defined by heating, deformation, and subsequent cooling, before the bite pads are attached to the occlusal wall. In some embodiments, the bite pads can be separately attached by a manufacturer or a user, for example, using adhesives or some other coupling mechanism.

The bite pads 310, 312 deform and displace around the teeth as the bite surface of the upper jaw contacts the bite pads 310, 312. The bite pads 310, 312 sufficiently yield to the teeth to allow the teeth to contact the bite pads 310, 312, without regard to the shape of the surface of the teeth. The lower jaw is, thus, allowed to find a balanced position relative to the upper jaw which will correspond to a position at which the facial muscles are generally at minimal tension. It has been observed that the lower jaw is naturally urged forward relative to the upper jaw in this position. This motion and the position of the lower jaw generally tend to urge the neck backward so that the cervical vertebrae substantially align, thereby facilitating an erect spine. The compliant property of the bite pads 310, 312 further allow slippage and repositioning of the upper and lower jaws relative to one another to adjust for changes in facial muscle tension, for example, when the head is turned to face the side of a user's body, or when a user is off-balance. The bite pads adjust relative to each other during uneven teeth clenching to provide the benefits derived herein.

Figure 21A:
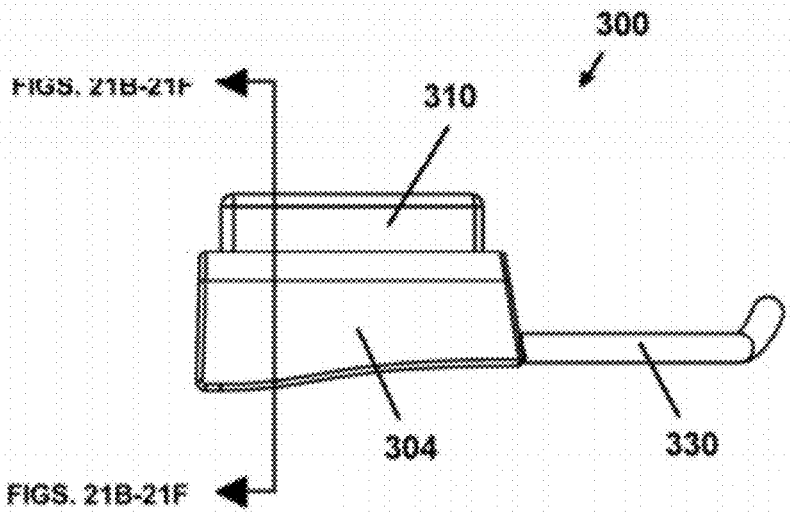
FIG. 21A is a side view of the oral appliance of FIG. 10A.
Figure 21B:
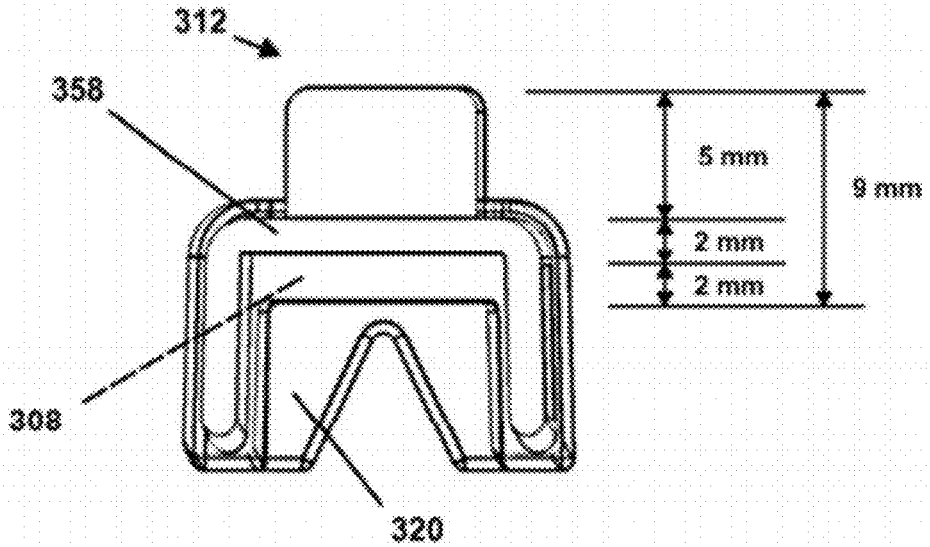
FIG. 21B is a cross-sectional anterior view of the left side of the oral appliance of FIG. 10A showing exemplary thickness dimensions.
Figure 21C:
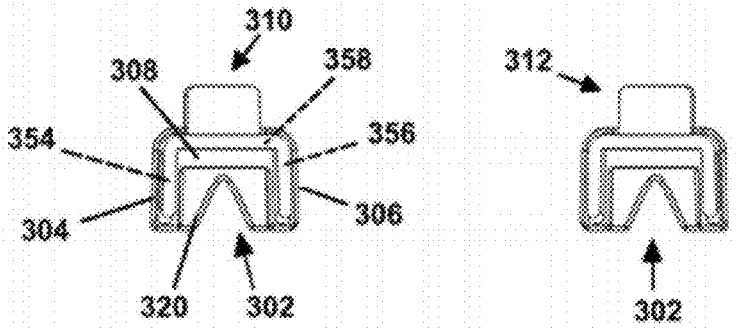
FIGS. 21C-21F are cross-sectional anterior views illustrating the deformation mechanics of the oral appliance of FIG. 10A.
Figure 21D:
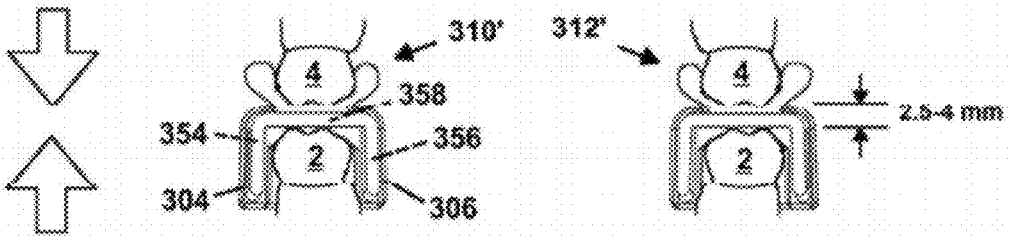
Figure 21E:
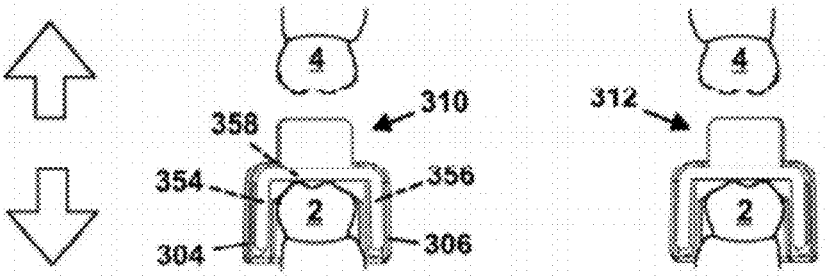
Figure 21F:
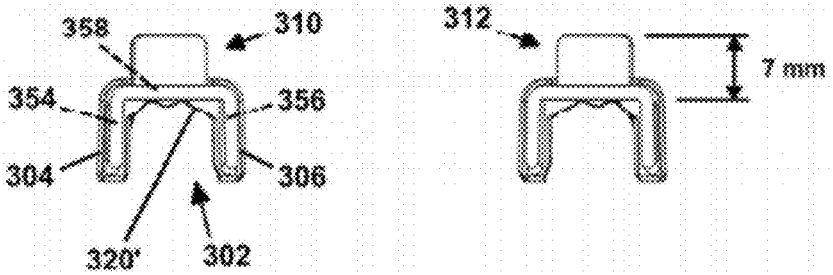

FIG. 21A is a side view of the oral appliance of FIG. 10A showing an approximate location along the oral appliance of cross-sections FIGS. 21B-21F. FIG. 21B illustrates exemplary thickness dimensions of an undeformed seating surface of the oral appliance. Preferably, in an undeformed state, the occlusal wall 108 and occlusal frame section 158 are each approximately 2 mm thick, and the bite pad 112 extends below the occlusal frame section 158 by about 5 mm. FIG. 21C depicts a cross-sectional anterior view of the oral appliance 300 about in the location of a first molar. FIG. 21D depicts a cross-section view similar to FIG. 21C showing teeth 2, 4 of the upper and lower jaw positioned when the oral appliance is fitted in the mouth of a user with the upper and lower jaw closed. As can be seen, the bite pads 310', 312' deform around the teeth of the upper jaw until the teeth seat and the bite pads 310', 312' reach maximum deformation, creating a cushion of fluid that, along with the occlusal frame sections 308, defines the gap between the teeth 2, 4. The gap is targeted to a range of between 2 mm and 7 mm. Preferably, the gap is 2.5 mm to 4 mm. More preferably, the gap is 2.5 mm to 3 mm. The gap can vary with the individual user and with applied clenching force. The gap can also be deliberately varied by the manufacturer to accommodate different applications or patient response. It has been observed that a gap of between 2 mm and 7 mm can result, for a substantial portion of a potential user base, in separation of the condyles of the mandible away from the maxilla and decompression of the articular disc, and further avoids contact between the TMJs and nerves associated with the TMJs. The benefits of the gap include the alignment of the user's spine which preferably allows the user to have increased strength and balance while performing normal day to day activities and also when participating in sporting events and in particular in team sports and contact sports. FIG. 21E shows the lower teeth held in the oral appliance 300 with the upper and lower jaw open. FIG. 21F shows that with the lower teeth removed, the fins 320 and the oral appliance 300 retain the shape of the teeth.

As has been described above, the oral appliance produces the three physiological results that can benefit a user's strength and balance. Further benefit is facilitated due to the wire frame 330 which offers substantially no resistance to air flow as the wire frame 330 is in the lower teeth line.

FIGS. 22-27C depict a further embodiment of the upper appliance 400 of the invention. The oral appliance 400 provides a pliable intermediate surface between the upper and lower jaws that partially yields to the anatomical imperfections in the individual's bite pattern to thereby encourage the lower jaw to arrange itself in a more balanced position relative to the upper jaw. The oral appliance 400 also defines a target gap between the bite surfaces of the upper and lower jaw so that the condyles of the mandible are urged away from the maxilla to decompress the articular disc of the TMJs and avoid applying undesirable pressure on the trigeminal nerve. As shown, the oral appliance 400 is also a mouth guard that covers the teeth and gums of the upper jaw to prevent and reduce injury to the teeth, arch, lip and gums, in addition to providing the other benefits described herein. In other embodiments, the oral appliance need not be a mouth guard.

The oral appliance 400 comprises a channel 402 formed by a lateral wall 404 connected with a lingual wall 406 by an occlusal wall 408, the channel 402 being adapted to receive teeth of a user's upper jaw. The lateral wall 404 and lingual wall 406 both extend substantially along the upper dental arch of a user when placed in the mouth, thereby forming a mouth guard to protect the structures of the upper jaw from trauma delivered directly to the upper jaw, and to protect the lower jaw from trauma caused by forceful contact with the upper jaw. In some embodiments, the channel 402 can extend approximately between the two second molars of the upper jaw. By extending between the second molars and not the third molars, the oral appliance 400 can avoid potentially triggering a gag reflex in a wearer. The oral appliance 400 covers the two second molars while the bite pads 410, 412 only cover the two first molar as well as the two first bicuspid and the two second bicuspid as described herein. In other embodiments, the channel can extend some other distance along the dental arch. For example, in some embodiments the channel can extend between the third molars of the dental arch. In still other embodiments, the channel can span different portions of the dental arch.

Preferably, a plurality of fins 420 are formed along the channel 402. The fins 420 are formed of a material that can soften upon boiling, allowing the fins 420 to be deformed by the teeth of the upper jaw, so that the channel 402 acquires a seating surface that conforms to the particular dental anatomy of the user. For example, the channel 402 and/or the fins 420 can be formed of a thermo-plastic material such as EVA. In an embodiment, the thermoplastic material is ELVAX® 150 which has a melting point of 145° F. and a Shore A durometer of 73, or ELVAX® 250 which has a melting point of 158° F. and a Shore A durometer of 80. ELVAX® branded EVA copolymer resins are available from DUPONT®. The thermo-plastic material can be translucent or transparent. In other embodiments, the thermo-plastic material can be some other EVA or non-EVA softenable material. A translucent or transparent material can be further tinted or modified to obtain a desired appearance. Alternatively, the thermo-plastic material can be opaque, and optionally be fabricated in one or more colors or combinations of colors, as permitted by known manufacturing techniques.

Figure 22:
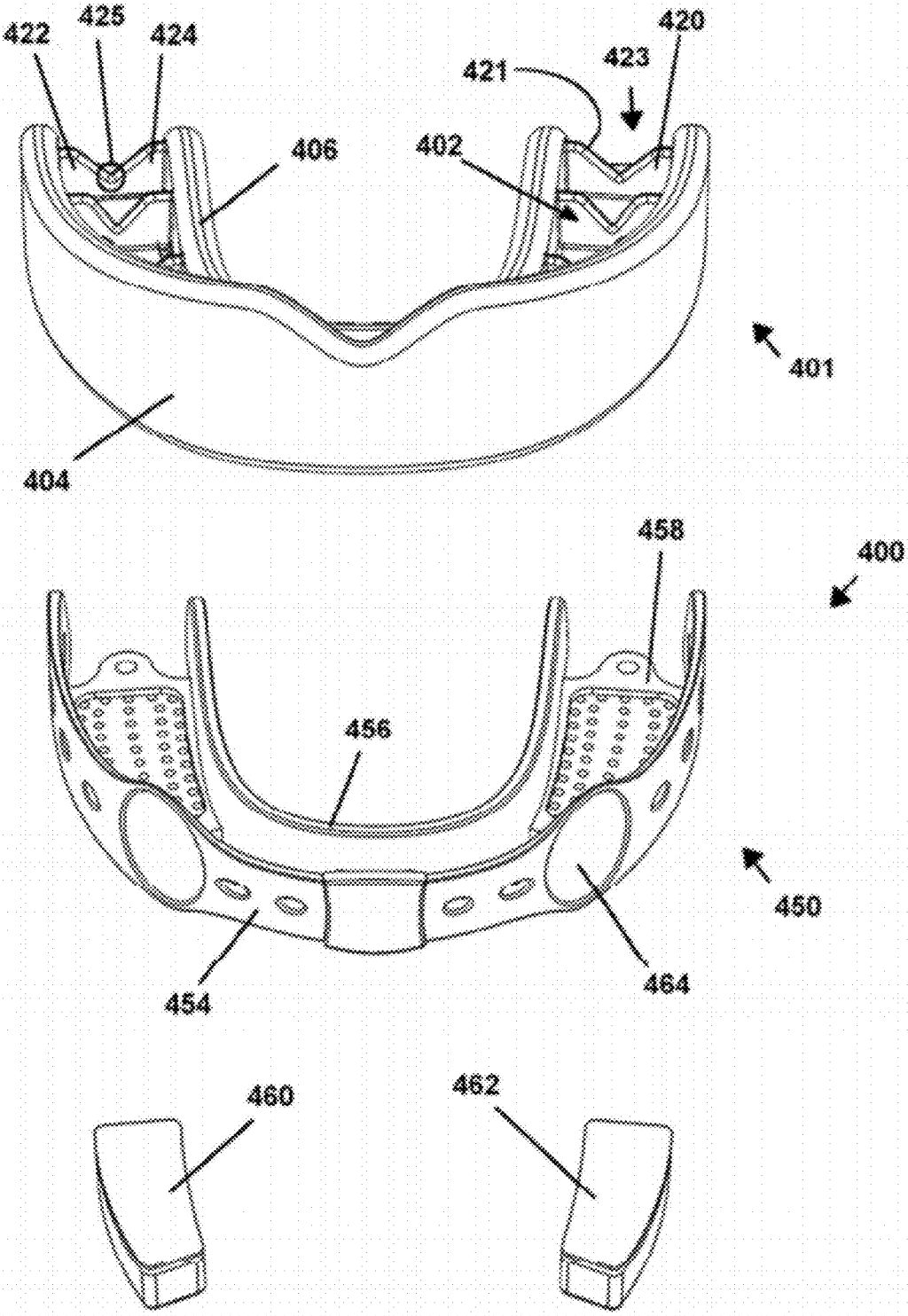
FIG. 22 is an exploded anterior top perspective view of another embodiment of the oral appliance.
Figure 23:
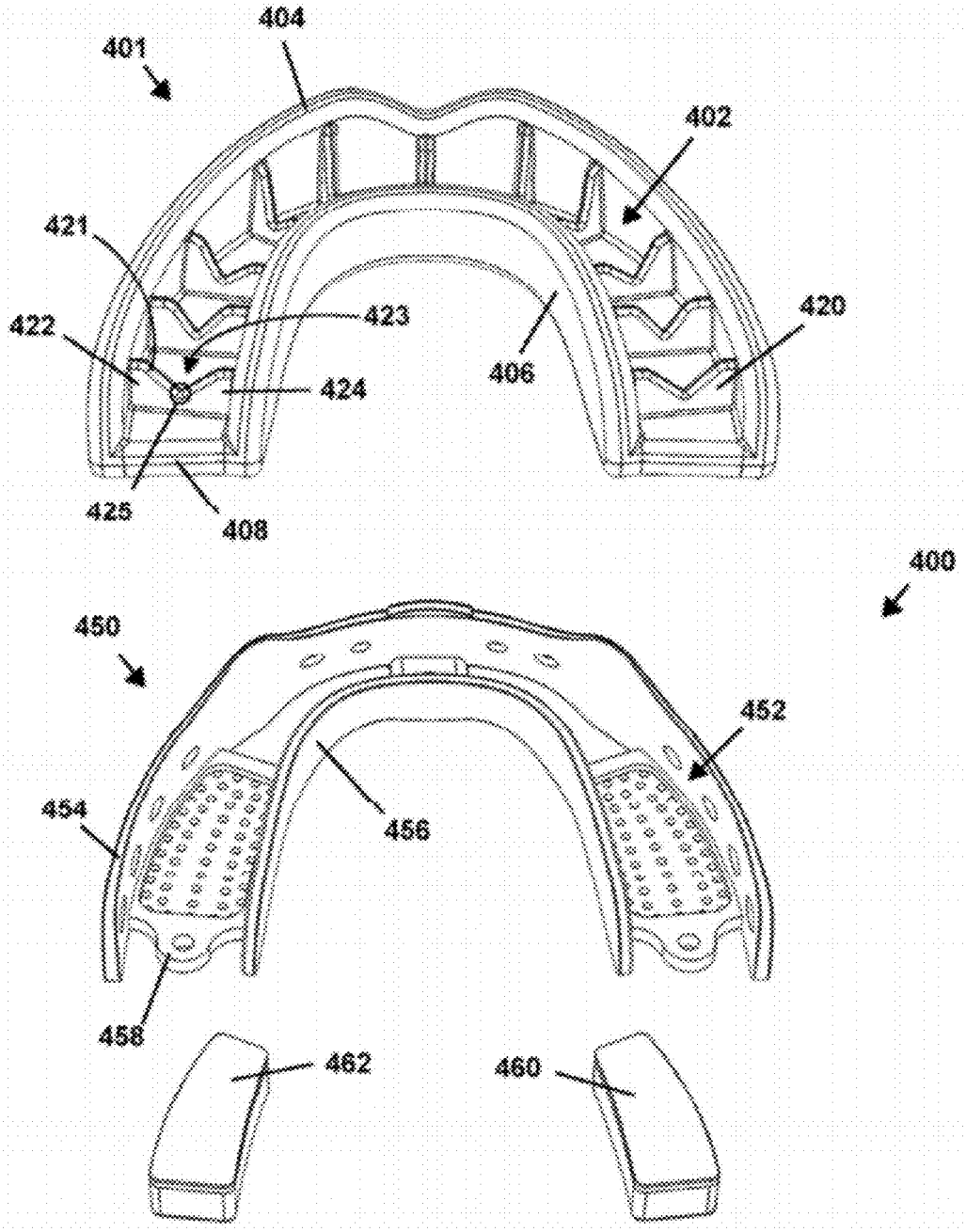
FIG. 23 is an exploded posterior top perspective view of the oral appliance of FIG. 22.
Figure 24:
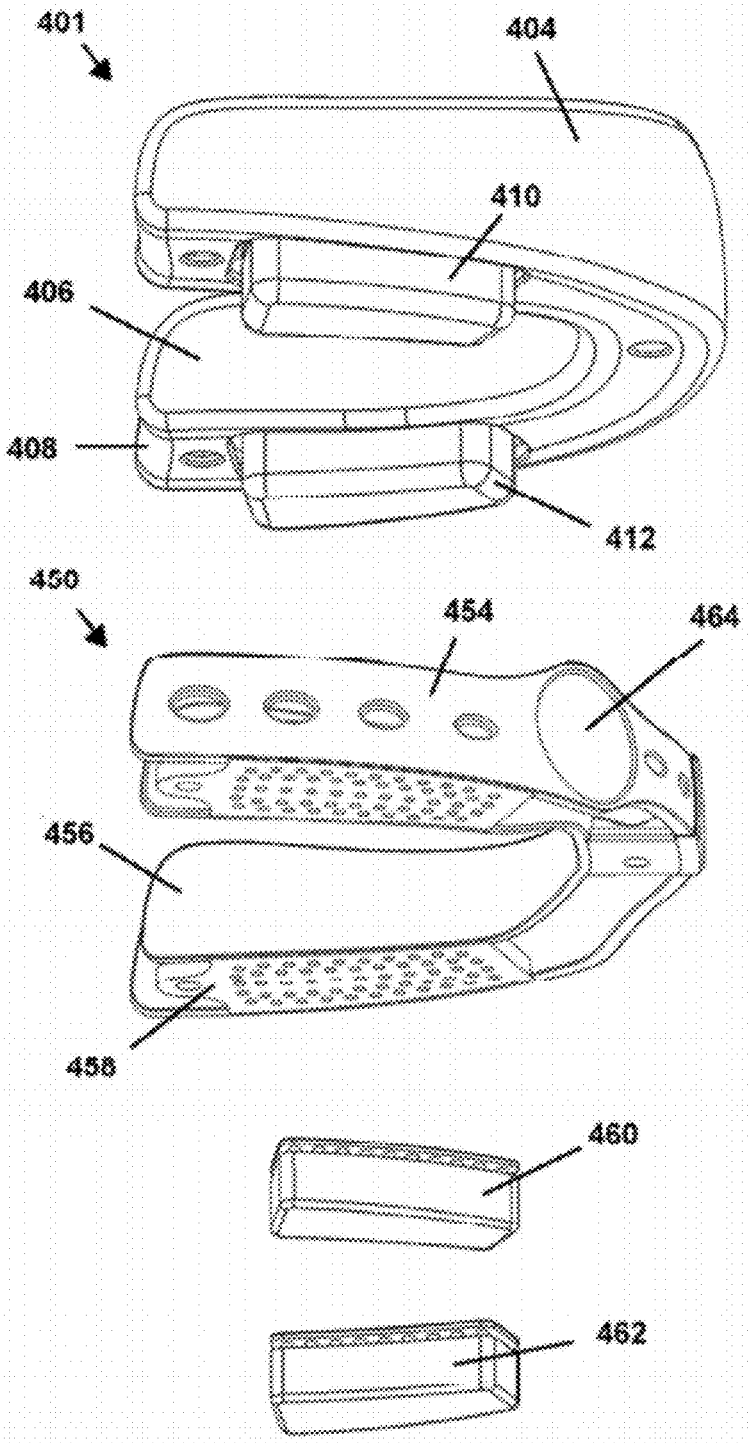
FIG. 24 is an exploded side and bottom perspective view of the oral appliance of FIG. 22.

A frame 450 is nested within and provides rigidity to the over-molded thermo-plastic material 401 that forms the walls 404, 406, 408 of the channel 402. The exploded views of FIGS. 22-24 provide unobstructed views of the frame 450, which includes a lateral frame wall 454 and a lingual frame wall 456 joined by occlusal frame sections 458. Optionally, the lateral frame wall 454 and/or the lingual frame wall 456 can have material removed to reduce the weight of the frame 450. As shown, the occlusal frame sections 458 differ substantially from that shown in FIG. 1B, in that the occlusal frame sections 458 spanning the molars and bicuspids are perforated. The perforated occlusal frame sections 458 allow thermoplastic material to penetrate the occlusal section to, upon cooling, provide good adhesion between the internal components 460, 462 of the bite pads 410, 412. As above, optionally the frame 450 can include a mounting surface 464 for applying a graphic symbol, insignia, hologram, or other additional feature. The frame 450 can comprise a material having a higher temperature melting or softening point than the over-molded material so that when the oral appliance is boiled, the frame 450 reinforces the oral appliance against undesirable and/or unintended deformation. Further, the frame 450 can comprise a material having sufficient stiffness to resist excessively and/or permanently deforming when placed in the mouth of a user and the user clenches his or her jaws. In an embodiment, the frame can comprise a copolymer material that does not include bisphenol-A (BPA). For example, in an embodiment the frame can comprise a polymer such as TRITAN™ copolyester from EASTMAN® Chemical Company. TRITAN™ EX 401 has a melting temperature of approximately 515-535° F. and a stiffness of 1500 MPa. The frame 450 and additional feature(s) can be visible through the over-molded material where the thermo-plastic over-molded material is a translucent or transparent material.

Preferably, when initially defining the seating surface, the user will bite down approximately to the occlusal frame sections 458 to establish a gap between the biting surface of the upper and lower jaws. As a fin 420 deforms, excess material can fill the spaces between adjacent fins 420 and a relatively deep seating surface can be formed for improved retention. Referring to FIGS. 25A-25D, the fins 420*a*-420*f* each have a rounded upper surface 421*a*-421*f* extending between a pair of sidewalls, the upper surface 421*a*-421*f* having a compound slope that can help reliably guide teeth when the user places the oral appliance in the mouth and additionally when the user clenches his or her jaws during the deformation process for forming a seating surface of the oral appliance. The sidewalls each have a lateral portion 422*a*-422*f* and a lingual portion 424*a*-424*f* with geometries that vary relative to each other, and from the second molar to the incisors, although in other embodiments the geometries need not necessary vary, and need not be shaped as shown in FIG. 25D. In general, the fins 420*a*-420*f* each has a V-shaped groove 423*a*-423*f* that guides an individual tooth relative to the channel 402 and relative to the spaces between fins 420*a*-420*f* so that the oral appliance 400 seats on the upper jaw of the user in an approximately predictable fashion. The channel 402 includes thirteen fins 420, but in other embodiments the channel can have fewer or more fins. The two portions of the sidewalls 422*a*-422*f* and 424*a*-424*f* meet to form V-shaped grooves 423*a*-423*f* in the fins 420*a*-420*f* respectively. It is noted that the V-shaped grooves 423*a*-423*f* include corresponding apexes 425*a*-425*f*. As if evident from FIG. 25D, the V-shaped fins are formed to accommodate the shapes of the teeth that are seated between the adjacent fins. Thus, as the molars are larger and wider, the V-shape in the corresponding fin 420*a* is wider with the portions 422*a*, 424*a* of the sidewalls of the fin 420*a* being about the same height. As the teeth become sharper and pointed toward the central teeth, the lateral portions 422*b*-422*f* of the sidewalls of the fin 420*b*-*g* are higher than the lingual portions 424*b*-424*f* of the sidewalls. In general though, the V-shape preferably defines slightly less than a right angle. The V-shaped grooves 423*a*-423*f* enables the fins 420*a*-420*f* to better form or mold around each tooth. It is to be noted that in other embodiments the grooves can have other shapes, such as U-shapes, in order to assist in the placement and seating of the teeth relative to the oral appliance and so that the fins form or mold around each tooth.

Figure 25A:
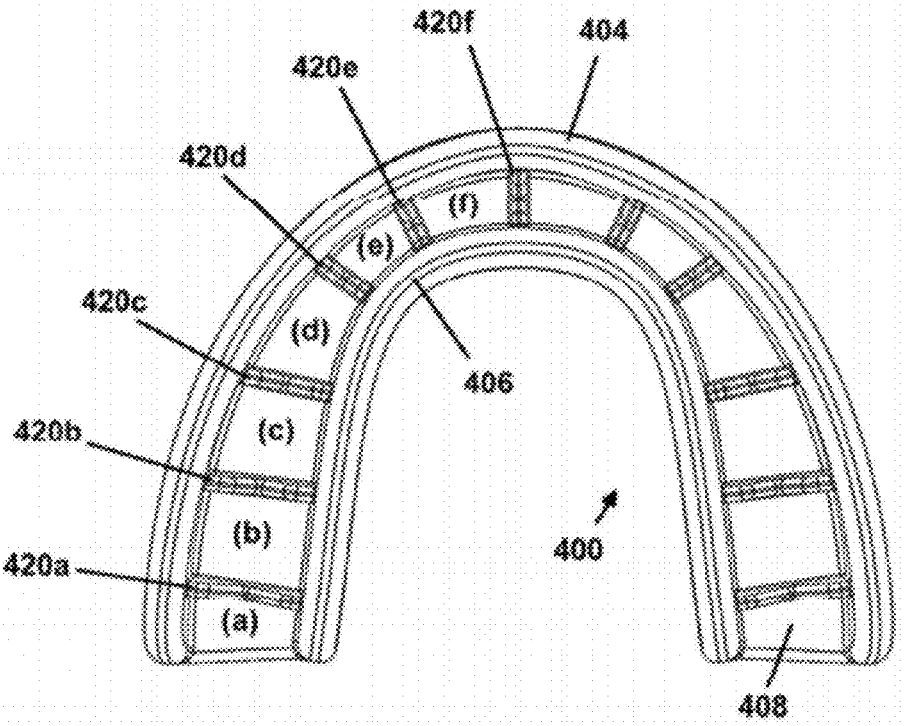
FIG. 25A is a plan view of the seating surface of the oral appliance of FIG. 22.
Figure 25B:
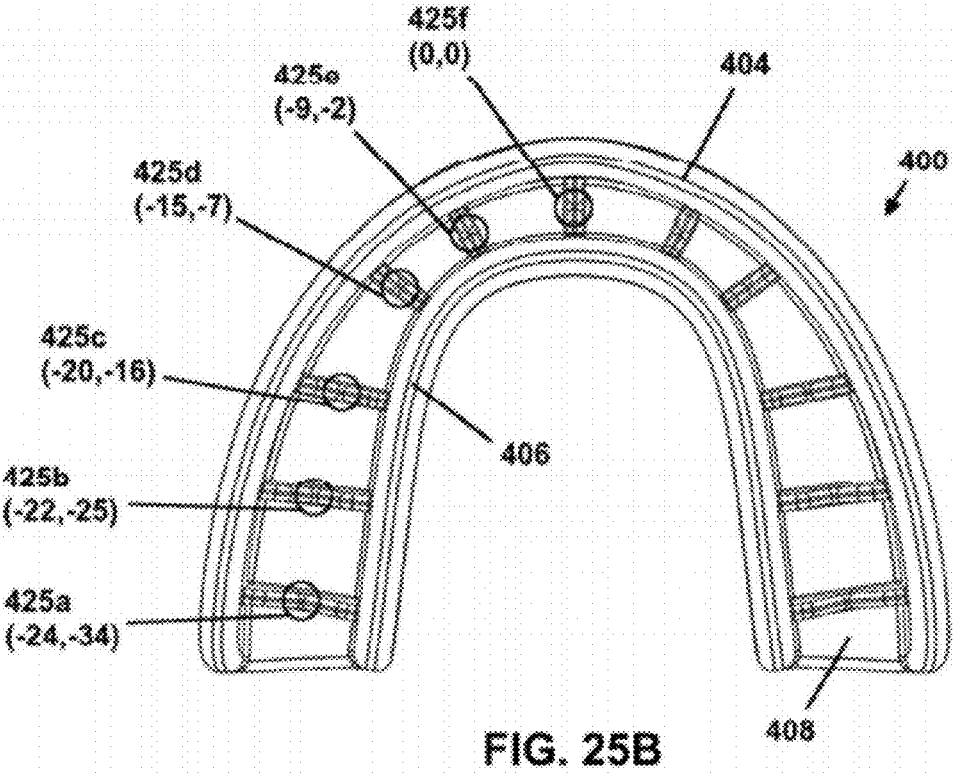
FIG. 25B is the plan view of FIG. 25A with exemplary distances of the fins of the seating surface relative to a central fin in x and y coordinates.
Figure 25C:
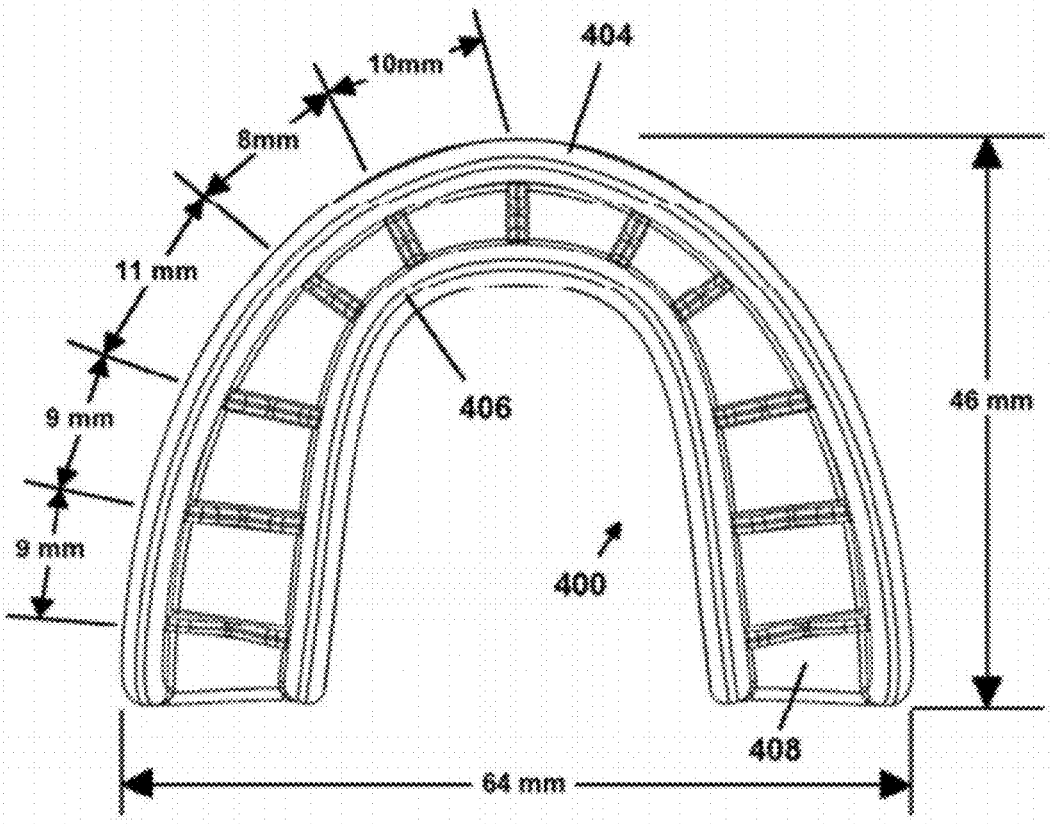
FIG. 25C is the plan view of FIG. 25A labeled with distances between fins and overall oral appliance dimensions.
Figure 25D:
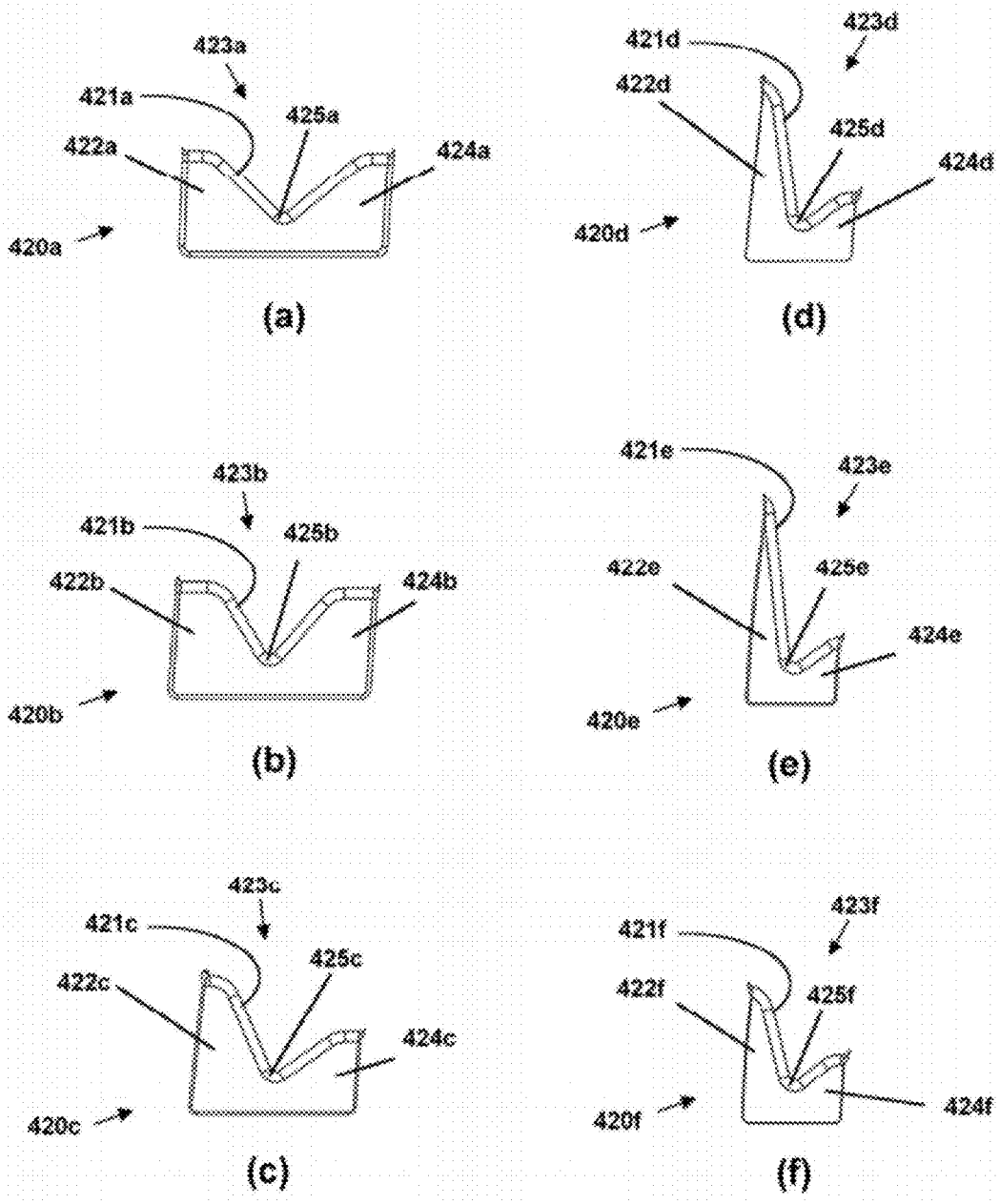
FIG. 25D is a series of isolated views of V-shaped fins of the seating surface of the embodiment of the oral appliance of FIG. 22.

FIGS. 25A, 25B and 25C illustrate exemplary dimensions and fin spacing of the embodiment of FIG. 22 to produce a suitable seating surface for an oral appliance useable for a substantial portion of a potential user base. In FIG. 25A, space (f) is adapted to receive a central tooth of the user, space (e) is adapted to receive a lateral tooth of a user, space (d) is adapted to receive a canine of the user and a first bicuspid, space (c) is adapted to receive the second bicuspid of the user, and spaces (b) and (a) are adapted to receive the first and second molars of the user. FIG. 25B shows relative distance (in millimeters), along the x- and y-directions of the page, of the apex 425*a*-425*f* of each groove 423*a*-423*f* from the apex 425*f* of the groove 423*f* of the fin 420*f* located centrally along the dental arch. For example, the fin 420*a*, located most distally from the central fin 420*f*, has an apex 425*a* that is 24 mm to the left of the groove of the central fin 420*f* and 34 mm posterior to the groove of the central fin 420*f*. FIG. 25C shows the approximate distance between fins (also in millimeters) and the overall dimensions of the oral appliance in the plane of the page. The fin spacing provided for the left side of the oral appliance is substantially mirrored along the right side of the oral appliance. It is to be understood that embodiments of oral appliances in accordance with the present invention need not have a seating surface as shown in FIGS. 25A-25D.

Figure 26A:
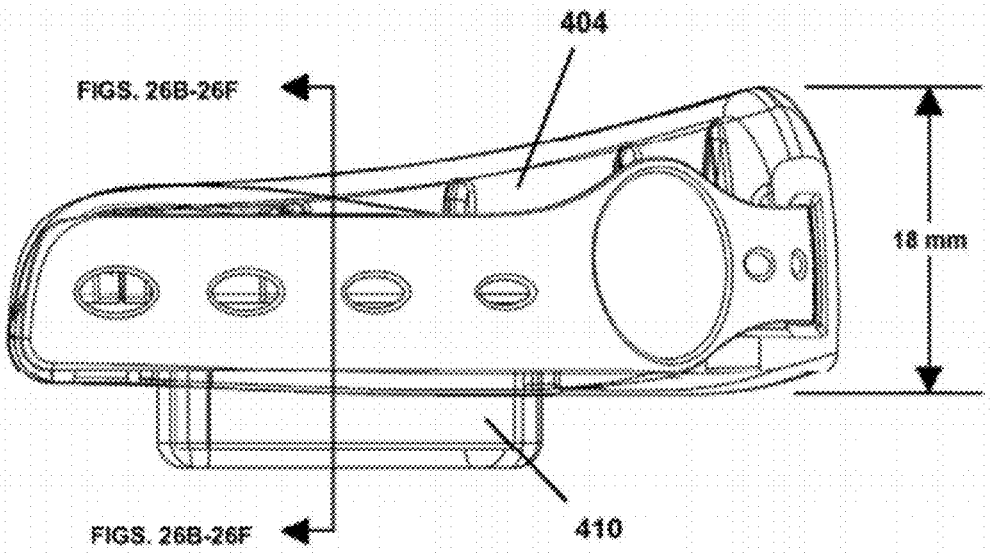
FIG. 26A is a side view of the oral appliance of FIG. 22.

FIG. 26A illustrates exemplary maximum height of the lateral wall 404 along the dental arch. FIG. 26A also shows the bite pads 410, 412 extending below the occlusal surface of the oral appliance. The bite surface of the upper teeth is separated from the bite surface of the lower teeth by a gap defined by the thickness of the occlusal frame sections 458 and the compressed thickness of bite pads 410, 412 extending caudally from the surface of the occlusal frame sections 458 opposite the channel 402. The bite pads 410, 412 extend preferably and approximately from the first molar to the first bicuspid on opposite sides of the upper jaw, although in other embodiments, the bite pads 410, 412 can extend along other portions of the dental arch. For example, in an embodiment, the bite pads 410, 412 can extend from the second molar to the second bicuspid.

Generally, the bite pads can be formed of any material that allows sufficient support during maximum compression and sufficient yield to the teeth of the lower jaw such that the lower jaw is free to reposition itself to a location of minimum stress. The bite pads 410, 412 are elastic, and, preferably, can comprise a pliable shell filled with a fluid. The bite pads 410, 412 include a core 460, 462 surrounded by a skin. As shown, the bite pads 410, 412 are not encapsulated by the over-molded material 401. The bite pads 410, 412 can include features that mate or register with the frame 450. Alternatively, the bite pads 410, 412 can be arranged relative to the frame 450 by a mold or jig. One method for arranging and mating the bite pads 410, 412 relative to the frame 450 is illustrated in FIGS. 27A-27C and described in detail below. In one embodiment, the skin can comprise a silicone shell that defines a space that is filled with silicone gel. The silicone gel can have a Shore OO durometer of 50, for example. The silicone shell can have a Shore A durometer between 50 and 70, for example. Silicone has a melting point of 280° F. and a silicone shell would resist melting during boiling. In other embodiments, the bite pads 410, 412 can comprise some other fluid. The fluid placed in the bite pads can be a liquid and also can be a gas. Additionally, the fluid can be a polymer that flows to perform the functions described herein. Thus, generally the bite pads can be liquid filled, air or gas filled or filled with a soft material such as silicone or a gel. Alternatively, the bite pads can be a flowable or deformable solid that may or may not be held within a pliable shell. Alternatively, the bite pads can be a composite material with different dampening properties that results based on the compression force. The bite pads can be made of a material that retains its properties without deformation at high temperatures, thereby permitting deformation of the fins 420, 420' and the channel 402, as shown in FIGS. 26C-26F, when the fins 420, 420' and channel 402 are softened by heating (for example, by boiling) without suffering permanent or undesirably excessive deformation of the bite pads. Alternatively, the seating surface of the oral appliance can be defined by heating, deformation, and subsequent cooling, before the bite pads are attached to the occlusal wall. In some embodiments, the bite pads can be separately attached by a manufacturer or a user, for example, using adhesives or some other coupling mechanism.

The bite pads 410, 412 deform and displace around the teeth as the bite surface of the lower jaw contacts the bite pads 410, 412. The bite pads 410, 412 sufficiently yield to the teeth to allow the teeth to contact the bite pads 410, 412, without regard to the shape of the surface of the teeth. The lower jaw is, thus, allowed to find a balanced position relative to the upper jaw which will correspond to a position at which the facial muscles are generally at minimal tension. It has been observed that the lower jaw is naturally urged forward relative to the upper jaw in this position. This motion and the position of the lower jaw generally tend to urge the neck backward so that the cervical vertebrae substantially align, thereby facilitating an erect spine. The compliant property of the bite pads 410, 412 further allow slippage and repositioning of the upper and lower jaws relative to one another to adjust for changes in facial muscle tension, for example, when the head is turned to face the side of a user's body, or when a user is off-balance. The bite pads adjust relative to each other during uneven teeth clenching to provide the benefits derived herein.

Figure 26B:
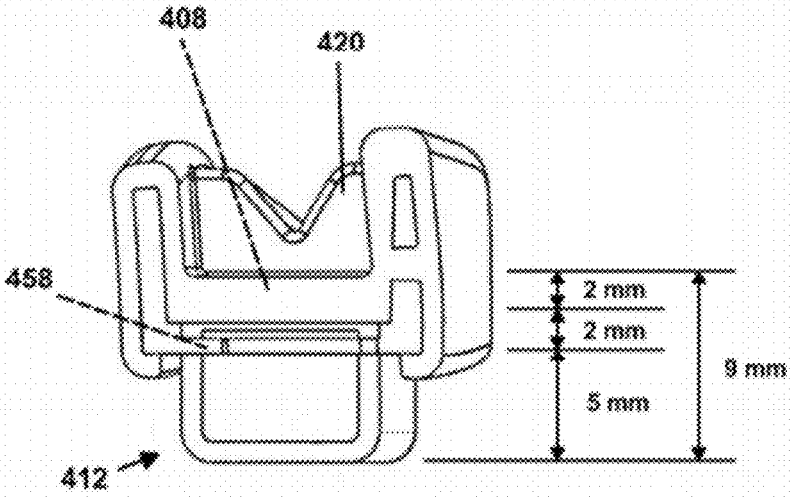
FIG. 26B is a cross-sectional anterior view of the left side of the oral appliance of FIG. 22 showing exemplary thickness dimensions.
Figure 26C:
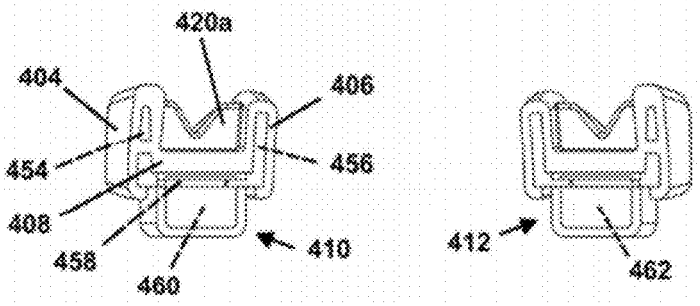
FIGS. 26C-26F are cross-sectional anterior views illustrating the deformation mechanism of the embodiment of the oral appliance of FIG. 22.
Figure 26D:
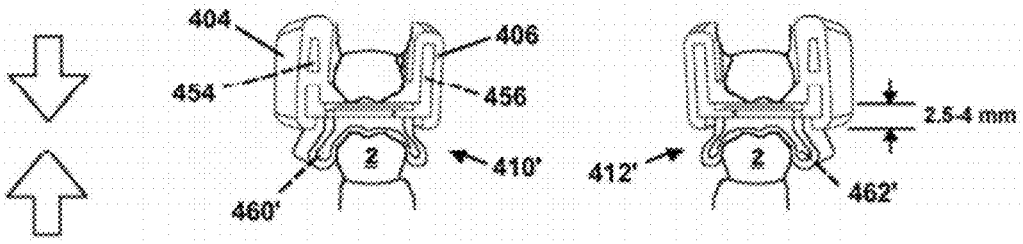
Figure 26E:
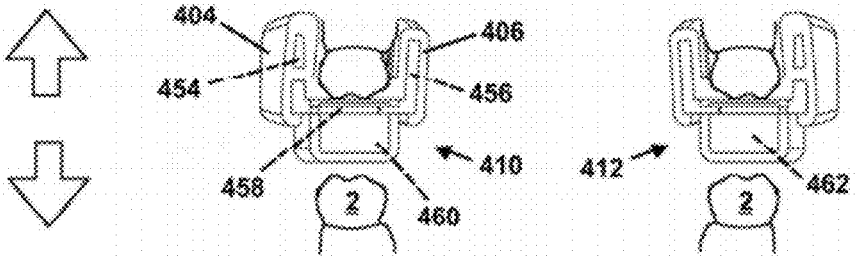
Figure 26F:
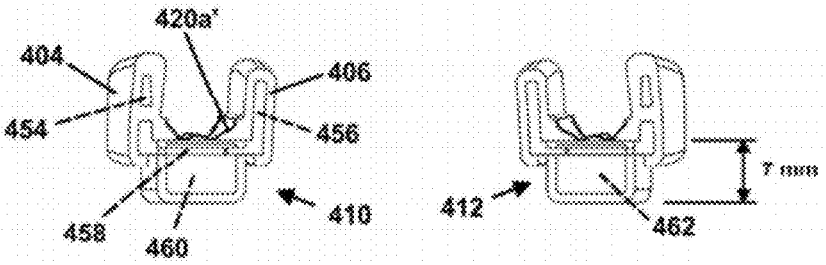
Figure 27A:
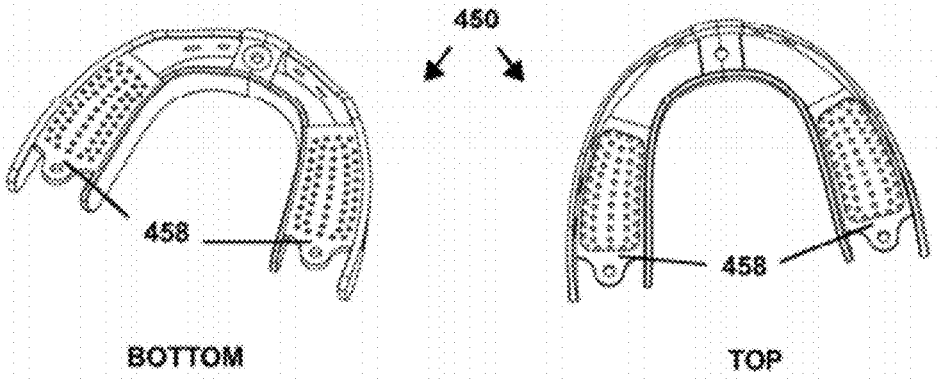
FIGS. 27A-27C illustrate an embodiment of a method in accordance with the present invention for forming bite pads and bonding the bite pads to a frame of the oral appliance of FIG. 22.
Figure 27B:
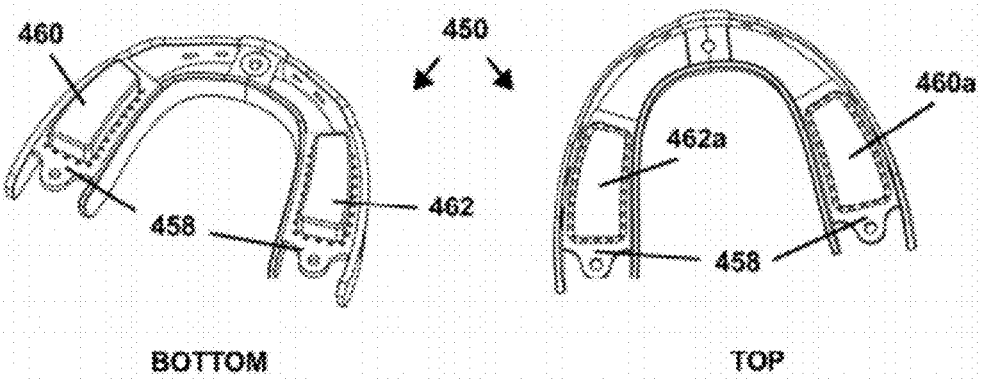
Figure 27C:
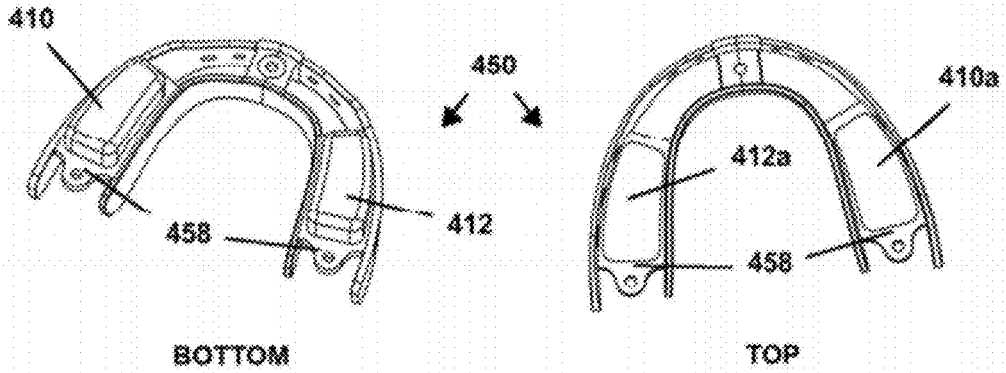

FIG. 26A is a side view of the oral appliance of FIG. 22 showing an approximate location along the oral appliance of cross-sections FIGS. 26B-26F. FIG. 26B illustrates exemplary thickness dimensions of an undeformed seating surface of the oral appliance. Preferably, in an undeformed state, the occlusal wall 108 and occlusal frame section 158 are each approximately 2 mm thick, and the bite pad 112 extends below the occlusal frame section 158 by about 5 mm. FIG. 26C depicts a cross-sectional anterior view of the oral appliance 400 about in the location of a first molar showing exemplary dimensions prior to defining a seating surface of the oral appliance 400. FIG. 26D depicts a cross-section view similar to FIG. 26B showing teeth 2, 4 of the upper and lower jaw positioned when the oral appliance is fitted in the mouth of a user with the upper and lower jaw closed. As can be seen, the bite pads 410', 412' deform around the teeth of the lower jaw until the teeth seat and the bite pads 410', 412' reach maximum deformation, creating a cushion of fluid that, along with the occlusal frame sections 458, defines the gap between the teeth 2, 4. The gap is targeted to a range of between 2 mm and 7 mm. Preferably, the gap is 2.5 mm to 4 mm. More preferably, the gap is 2.5 mm to 3 mm. The gap can vary with the individual user and with an applied clenching force. The gap can also be deliberately varied by the manufacturer to accommodate different applications or patient response. It has been observed that a gap of between 2 mm and 7 mm can result, for a substantially portion of a potential user base, in separation of the condyles of the mandible away from the maxilla and decompression of the articular disc, and further avoids contact between the TMJs and nerves associated with the TMJs. The benefits of the gap include the alignment of the user's spine which preferably allows the user to have increased strength and balance while performing normal day to day activities and also when participating in sporting events, and, in particular, in team sports and contact sports. FIG. 26E shows the upper teeth held in the oral appliance 400 with the upper and lower jaws open. FIG. 26F shows that, with the upper teeth removed, the fins 420' and the channel 402 of the oral appliance 400 retain the shape of the teeth.

FIGS. 27A-27C each illustrate bottom and top views of an embodiment of a method in accordance with the present invention for forming bite pads 410, 412 and bonding the bite pads 410, 412 to the frame 450. The cores 460, 462 are positioned on the perforated occlusal frame sections 458 of the frame 450 so that at least a row of perforations surrounds each of the cores 460, 462. The cores 460, 462 can then be heated so that a portion of the cores 460, 462 flows through the perforations. The cores 460, 462 are then cooled and a portion 460*a*, 462*a* of the cores 460,462 encapsulates a portion of the occlusal frame sections 458 to anchors the cores 460, 462 to the frame 450, as can be seen in FIG. 27B. The skin material can then be placed over each of the cores 460, 462, and heated so that the skin material flows through the unobstructed row of perforations. The skin material is then cooled to complete the bite pads, with a portion 410*a*, 412*a* of the bite pads 410, 412 encapsulating both respective cores 460,462 and a portion of the occlusal frame sections 458 to anchor the bite pads 410, 412 to the frame 450, as can be seen in FIG. 27C. The frame 450 can then be over-molded with the thermo-plastic material 401 to form the oral appliance 400. An oral appliance seated on the lower jaw, such as shown in FIGS. 10A-21F, can optionally be fabricated using the method of FIGS. 27A-27C.

The previous description of the preferred embodiments is provided to enable any person skilled in the art to make or use the embodiments of the present invention. While the invention has been particularly shown and described with reference to preferred embodiments thereof, it will be understood by those skilled in the art that various changes in form and details may be made therein without departing from the spirit and scope of the invention.

The invention claimed is:

1. A neuromuscular oral appliance for placement in a mouth of a user comprising:

a channel with a base adapted to accept teeth from one of a lower jaw and an upper jaw of the mouth;

wherein the channel is deformable to at least partially conform to a shape of the accepted teeth upon prior heating and subsequent cooling;

a pliable, elastic bite pad extending opposite the channel, the pliable, elastic bite pad being adapted to contact teeth from the other of the lower jaw and the upper jaw when the oral appliance is placed in the mouth;

wherein the pliable, elastic bite pad is adapted to partially collapse upon contact with the teeth such that a gap between the lower jaw and the upper jaw is maintainable within a predefined range; and wherein the channel includes two portions, each portion spanning at least from the first bicuspid to the second molar on opposite sides of the mouth and wherein the two portions are connected by a wire.

2. A neuromuscular oral appliance for placement in a mouth of a user comprising:

a channel adapted to accept teeth from one of a lower jaw and an upper jaw of the mouth;

wherein the channel is deformable to at least partially conform to a shape of the accepted teeth;

a pair of bite pads extending adapted to contact teeth from the other of the lower jaw and the upper jaw when the oral appliance is placed in the mouth;

wherein the pair of bite pads is adapted to partially collapse upon contact with the teeth such that a gap between the lower jaw and the upper jaw is maintainable within a predefined range.

3. The oral appliance of claim 2, wherein each bite pad from said pair of bite pads includes a skin encapsulating a core.

4. The oral appliance of claim 3, wherein said core is a silicone gel and said skin is a silicone encasement.

5. The oral appliance of claim 3, wherein said core is a fluid.

6. The oral appliance of claim 2, wherein upon contact the pair of bite pads extends from a first bicuspid to a first molar of the other of the lower jaw and the upper jaw on opposite sides of the mouth.

7. The oral appliance of claim 2, wherein the predefined range is 2 millimeters to 7 millimeters.

8. The oral appliance of claim 2, wherein the predefined range is 2.5 millimeters to 4 millimeters.

9. The oral appliance of claim 2, further comprising:

a frame;

wherein the channel is formed over the frame; and wherein the frame has a higher melting temperature than the channel.

10. The oral appliance of claim 9, wherein the channel is ethylene vinyl acetate (EVA) and the frame is TRITAN™ copolyester.

11. The oral appliance of claim 9, wherein the pair of bite pads is bonded to the frame.

12. The oral appliance of claim 2, wherein the channel includes a plurality of fins arranged along at least a portion of the length of the channel, each of the plurality of fins having a groove to guide the teeth into the channel.

13. The oral appliance of claim 12, wherein the grooves of the plurality of fins are "V"-shaped.

14. The oral appliance of claim 12, wherein the arrangement of fins along the channel is mirrored along a midline of the oral appliance.

15. The oral appliance of claim 2, wherein the channel includes a lingual wall, a lateral wall, and an occlusal wall connected between the lingual wall and the lateral wall and wherein the lateral wall extends at least to a gumline of the mouth to protect the accepted teeth from trauma.

16. The oral appliance of claim 2, wherein the channel includes two portions, each portion spanning at least from the first bicuspid to the second molar on opposite sides of the mouth and wherein the two portions are connected by a wire.

17. A neuromuscular oral appliance for placement in a mouth of a user comprising:

a channel with a base adapted to accept teeth from an upper jaw of the mouth;

a plurality of fins arranged along at least a portion of the length of the channel, each of the plurality of fins having a groove to guide the teeth into the channel;

wherein the channel and the fins are deformable to at least partially conform to a shape of the accepted teeth upon heating the channel and the fins to a melting temperature;

a pair of bite pads adapted to contact teeth from a lower jaw when the oral appliance is placed in the mouth;

wherein upon contact the pair of bite pads extends from a first bicuspid to a first molar of the lower jaw on opposite sides of the mouth; and wherein the pair of bite pads is adapted to partially and elastically collapse upon contact with the teeth of the lower jaw such that a gap between the lower jaw and the upper jaw is maintainable within a predefined range.

18. The oral appliance of claim 17, further comprising:

a frame;

wherein the channel is formed over the frame; and wherein the frame has a higher melting temperature than the channel and the fins.

19. The oral appliance of claim 17, wherein each bite pad from said pair of bite pads includes a silicon skin encapsulating a silicone gel core;

wherein the channel is ethylene vinyl acetate (EVA); and wherein the frame is TRITAN™ copolyester.

20. A neuromuscular oral appliance for placement in a mouth of a user comprising:

a channel with a base adapted to accept teeth from a lower jaw of the mouth, the channel having two portions, each portion spanning at least from the first bicuspid to the second molar on opposite sides of the mouth;

a wire connecting the two portions of the channel;

a plurality of fins arranged along at least a portion of the length of each of the two portions of the channel, each of the plurality of fins having a groove to guide the teeth into the channel;

wherein the channel and the fins are deformable to at least partially conform to a shape of the accepted teeth upon heating the channel and the fins to a melting temperature;

a pair of bite pads extending from respective portions of the channel and adapted to contact teeth from a upper jaw when the oral appliance is placed in the mouth;

wherein upon contact the pair of bite pads extends from a first bicuspid to a first molar of the upper jaw on opposite sides of the mouth; and wherein the pair of bite pads is adapted to partially and elastically collapse upon contact with the teeth of the upper jaw such that a gap between the lower jaw and the upper jaw is maintainable within a predefined range.

21. The oral appliance of claim 20, further comprising:

a frame having two portions;

wherein the two portions of the channel are formed over respective portions of the frame; and wherein the frame has a higher melting temperature than the channel and the fins.

22. The oral appliance of claim 21, wherein each bite pad from said pair of bite pads includes a silicon skin encapsulating a silicone gel core;

wherein the channel is ethylene vinyl acetate (EVA); and wherein the frame is TRITAN™ copolyester.

23. A neuromuscular oral appliance for placement in a mouth of a user comprising:

a frame;

a channel molded over the frame with a base adapted to accept teeth from one of an upper jaw and a lower jaw of the mouth;

wherein the channel is deformable to at least partially conform to a shape of the accepted teeth upon heating to a melting temperature;

wherein the frame has a higher melting temperature than the channel;

a pliable, elastic bite pad extending opposite the channel, the pliable, elastic bite pad being adapted to contact teeth from the other of the upper jaw and the lower jaw when the oral appliance is placed in the mouth;

wherein the pliable, elastic bite pad is adapted to partially collapse upon contact with the teeth of the other of the upper jaw and the lower jaw such that a gap between the lower jaw and the upper jaw is maintainable within a predefined range.

24. The oral appliance of claim 23, wherein each bite pad from said pair of bite pads includes a silicon skin encapsulating a silicone gel core;

wherein the channel is ethylene vinyl acetate (EVA); and wherein the frame is TRITAN™ copolyester.

* * * * *